US010197245B1

(12) United States Patent
Chen et al.

(10) Patent No.: US 10,197,245 B1
(45) Date of Patent: Feb. 5, 2019

(54) ASYMMETRIC VISION ENHANCEMENT OPTICS, LUMINAIRES PROVIDING ASYMMETRIC LIGHT DISTRIBUTIONS AND ASSOCIATED METHODS

(71) Applicant: ABL IP Holding LLC, Decatur, GA (US)

(72) Inventors: Jie Chen, Snellville, GA (US); Yinan Wu, Dunwoody, GA (US); John Bryan Harvey, Newark, OH (US); Craig Eugene Marquardt, Covington, GA (US); Charles H. Fails, Marietta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 260 days.

(21) Appl. No.: 15/347,604

(22) Filed: Nov. 9, 2016

Related U.S. Application Data

(60) Provisional application No. 62/252,938, filed on Nov. 9, 2015.

(51) Int. Cl.
*F21V 1/00* (2006.01)
*F21V 11/00* (2015.01)
(Continued)

(52) U.S. Cl.
CPC ..... *F21V 13/04* (2013.01); *F21V 7/04* (2013.01); *F21V 23/06* (2013.01)

(58) Field of Classification Search
CPC ... F21V 13/04; F21V 7/04; F21V 7/10; F21V 23/06
See application file for complete search history.

(56) References Cited

U.S. PATENT DOCUMENTS 1,551,274 A 8/1925 Townsend
2,170,912 A 8/1939 Rolph
(Continued)

FOREIGN PATENT DOCUMENTS

EP 2247978 1/2009
JP 2004288866 A 10/2004
(Continued)

OTHER PUBLICATIONS

NGL 2009, Press Release, Next Generations Luminaires, Feb. 11, 2010, 16 pages.
(Continued)

*Primary Examiner* — Joseph L Williams
(74) *Attorney, Agent, or Firm* — Kilpatrick Townsend & Stockton LLP

(57) ABSTRACT

Optics for asymmetrically redirecting light from one or more light engines include a dome optic, and first and second reflecting surfaces. The dome optic refracts light emitted by the light engines. The first reflecting surface redirects at least a portion of the light that is initially emitted toward a backward horizontal direction, toward the forward horizontal direction. The first reflecting surface extends substantially vertically and along a transverse horizontal direction, proximate to and behind the dome optic, and has a height greater than or equal to a height of the dome optic. The second reflecting surface reflects downwardly at least a portion of the refracted light that is initially emitted in the forward horizontal direction. The second reflecting surface is proximate to the dome optic and forward of the dome optic, and forms an angle of 45 degrees or more with respect to vertical.

20 Claims, 12 Drawing Sheets

(51) Int. Cl.

| | |
|---|---|
| ***F21V 13/04*** | (2006.01) |
| ***F21V 7/04*** | (2006.01) |
| ***F21V 23/06*** | (2006.01) |

(56) References Cited

U.S. PATENT DOCUMENTS

| | | | |
|---|---|---|---|
| 2,662,165 | A | 12/1953 | Franck |
| 3,191,022 | A | 6/1965 | Wince |
| 3,278,743 | A | 10/1966 | Franck |
| 3,283,140 | A | 11/1966 | Rex |
| 3,340,393 | A | 9/1967 | Franck et al. |
| 3,459,936 | A | 8/1969 | Miller |
| 3,524,051 | A | 8/1970 | Baldwin et al. |
| 3,679,889 | A | 7/1972 | Franck |
| 3,766,375 | A | 10/1973 | Edman et al. |
| 4,085,318 | A | 4/1978 | Odle et al. |
| 4,451,875 | A | 5/1984 | Odle et al. |
| 5,130,761 | A | 7/1992 | Tanaka |
| 5,481,445 | A | 1/1996 | Sitzema et al. |
| 5,929,788 | A | 7/1999 | Vukosic |
| 6,095,663 | A | 8/2000 | Pond et al. |
| 6,373,630 | B1 | 4/2002 | Lee et al. |
| 6,971,772 | B1 | 12/2005 | Abdelsamed et al. |
| 7,055,996 | B2 | 6/2006 | Pond et al. |
| 7,245,203 | B2 | 7/2007 | Stephens et al. |
| 7,347,586 | B2 | 3/2008 | Izardel |
| 7,445,359 | B2 | 11/2008 | Chang |
| 7,445,362 | B2 | 11/2008 | Compton et al. |
| 7,566,911 | B2 | 7/2009 | Jyo |
| 7,665,866 | B2 | 2/2010 | Mayer et al. |
| 7,679,281 | B2 | 3/2010 | Kim et al. |
| 7,766,511 | B2 | 8/2010 | Zampini et al. |
| 7,798,678 | B2 | 9/2010 | Destian |
| 7,854,536 | B2 | 12/2010 | Holder et al. |
| 7,896,532 | B2 | 3/2011 | Hsu et al. |
| 7,959,326 | B2 | 6/2011 | Laporte |
| 8,167,463 | B2 | 5/2012 | Loh |
| 8,215,799 | B2 | 7/2012 | Vanden Eynden et al. |
| 8,267,553 | B2 | 9/2012 | Liang et al. |
| 8,348,475 | B2 | 1/2013 | Wilcox et al. |
| 8,430,523 | B1 | 4/2013 | Smith |
| 8,434,912 | B2 | 5/2013 | Holder et al. |
| 8,439,525 | B2 | 5/2013 | Abdelsamed et al. |
| 8,511,864 | B2 | 8/2013 | Holder et al. |
| 8,562,190 | B2 | 10/2013 | Ostrowski et al. |
| 8,628,222 | B2 | 1/2014 | Kelley |
| 8,953,926 | B1 | 2/2015 | Kelley et al. |
| 9,080,746 | B2 | 7/2015 | Chen et al. |
| 2003/0063476 | A1 | 4/2003 | English et al. |
| 2006/0072314 | A1 | 4/2006 | Rains |
| 2007/0019416 | A1 | 1/2007 | Han et al. |
| 2007/0242441 | A1 | 10/2007 | Aldrich et al. |
| 2007/0284592 | A1 | 12/2007 | Haase |
| 2008/0239722 | A1 | 10/2008 | Wilcox |
| 2009/0225551 | A1 | 9/2009 | Chang et al. |
| 2009/0295266 | A1 | 12/2009 | Ramer et al. |
| 2009/0316384 | A1 | 12/2009 | Kanayama et al. |
| 2010/0008088 | A1 | 1/2010 | Koizumi et al. |
| 2010/0014290 | A1 | 1/2010 | Wilcox |
| 2010/0033985 | A1 | 2/2010 | Hsu et al. |
| 2010/0039810 | A1 | 2/2010 | Holder et al. |
| 2010/0302786 | A1 | 12/2010 | Wilcox et al. |
| 2011/0089453 | A1 | 4/2011 | Min |
| 2011/0141734 | A1 | 6/2011 | Li et al. |
| 2011/0215721 | A1 | 9/2011 | Rains, Jr. et al. |
| 2012/0002412 | A1 | 1/2012 | Cheng |
| 2012/0026728 | A1 | 2/2012 | Lou et al. |
| 2012/0026732 | A1 | 2/2012 | Fricke |
| 2012/0050889 | A1 | 3/2012 | Lu et al. |
| 2012/0120645 | A1 | 5/2012 | Hawkins et al. |
| 2012/0195040 | A1 | 8/2012 | Treanton |
| 2012/0212138 | A1 | 8/2012 | Jungwirth et al. |
| 2012/0287649 | A1 | 11/2012 | Kelley |
| 2012/0300488 | A1 | 11/2012 | Broughton |
| 2012/0307503 | A1 | 12/2012 | Wilcox et al. |
| 2012/0316384 | A1 | 12/2012 | Arnold |
| 2013/0094209 | A1 | 4/2013 | Yu |
| 2013/0235580 | A1 | 9/2013 | Smith |
| 2014/0016326 | A1 | 1/2014 | Dieker et al. |
| 2014/0085905 | A1 | 3/2014 | Broughton |
| 2014/0268692 | A1 | 9/2014 | Edmond et al. |
| 2016/0053952 | A1 | 2/2016 | Kuti et al. |
| 2017/0031080 | A1 | 2/2017 | Speer et al. |

FOREIGN PATENT DOCUMENTS

| | | |
|---|---|---|
| WO | 2008/0139383 | 11/2008 |
| WO | 2010019810 | 2/2010 |
| WO | 2011/100756 | 8/2011 |
| WO | 2012/118828 | 9/2012 |
| WO | 2014/145802 | 9/2014 |

OTHER PUBLICATIONS

Non-Final Office Action for U.S. Appl. No. 15/347,613, dated Jun. 14, 2017, 20 pages.

Notice of Allowance for U.S. Appl. No. 15/347,613, dated Dec. 13, 2017, 5 pages.

FIG. 1A
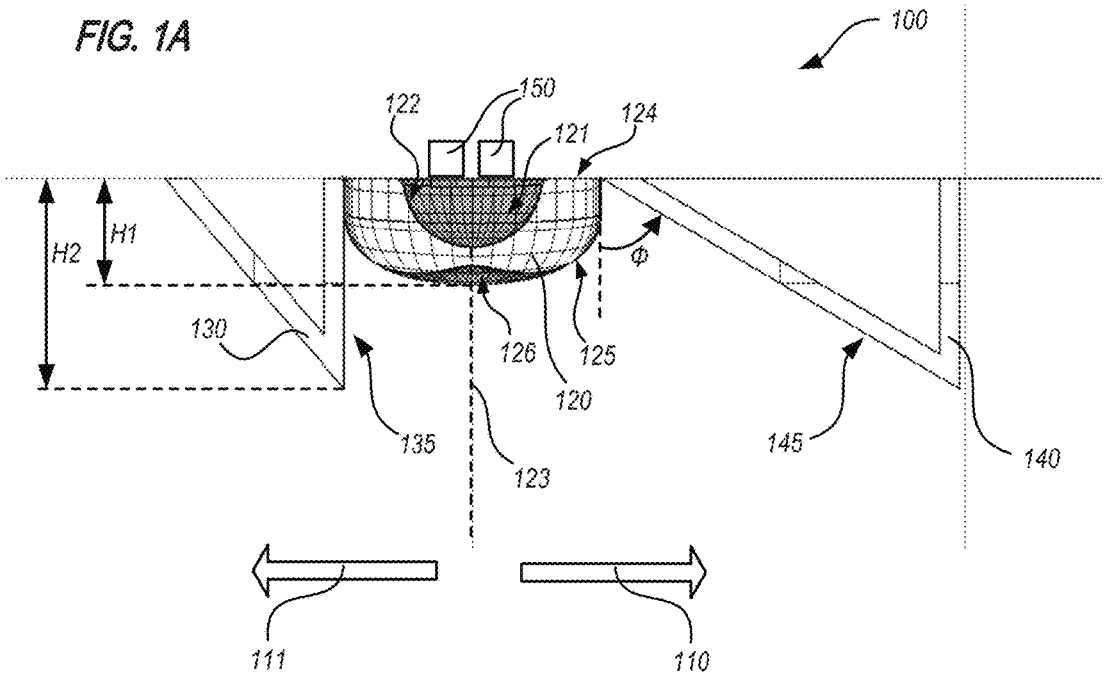
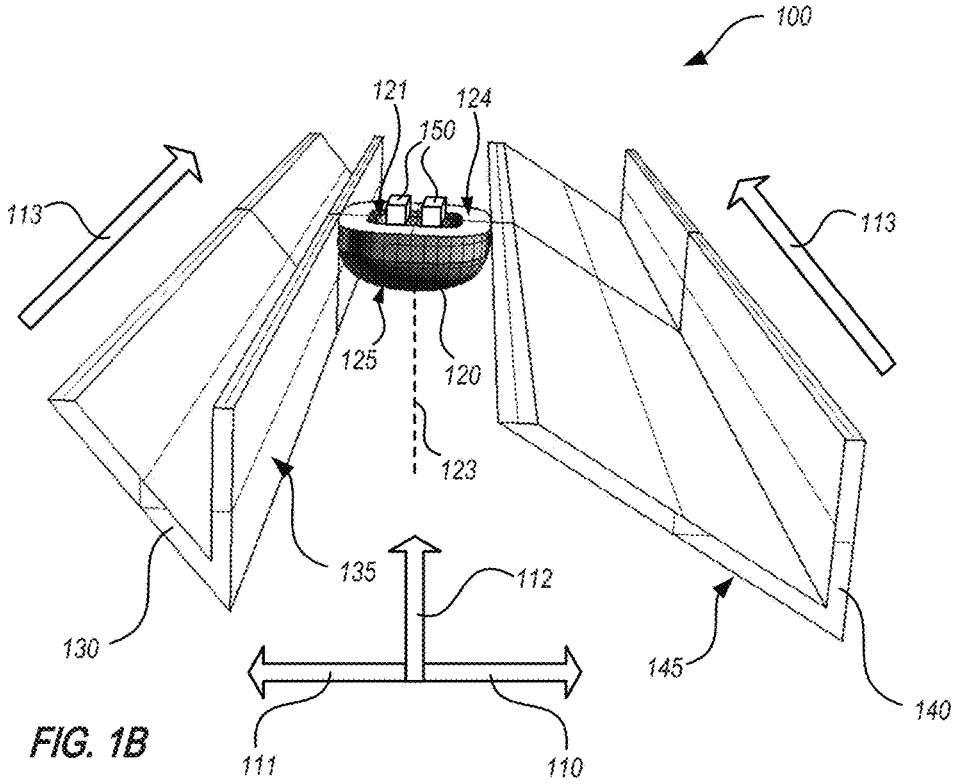
FIG. 1B

FIG. 3
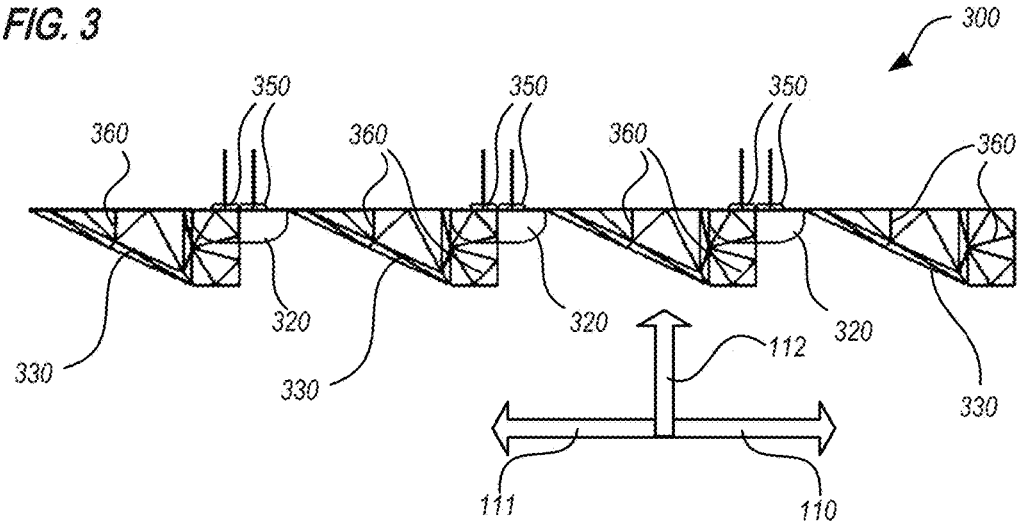
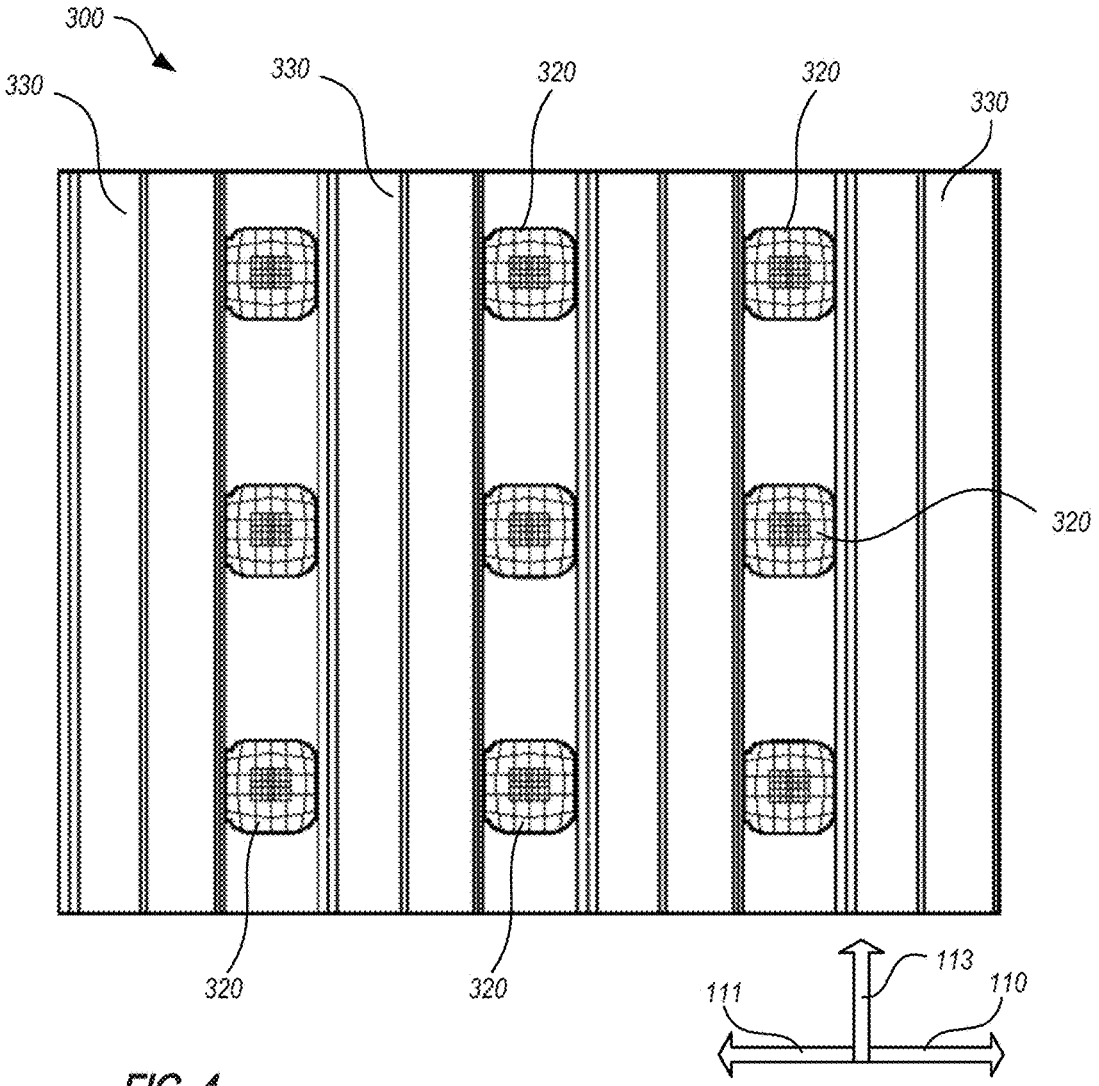
FIG. 4

FIG. 8
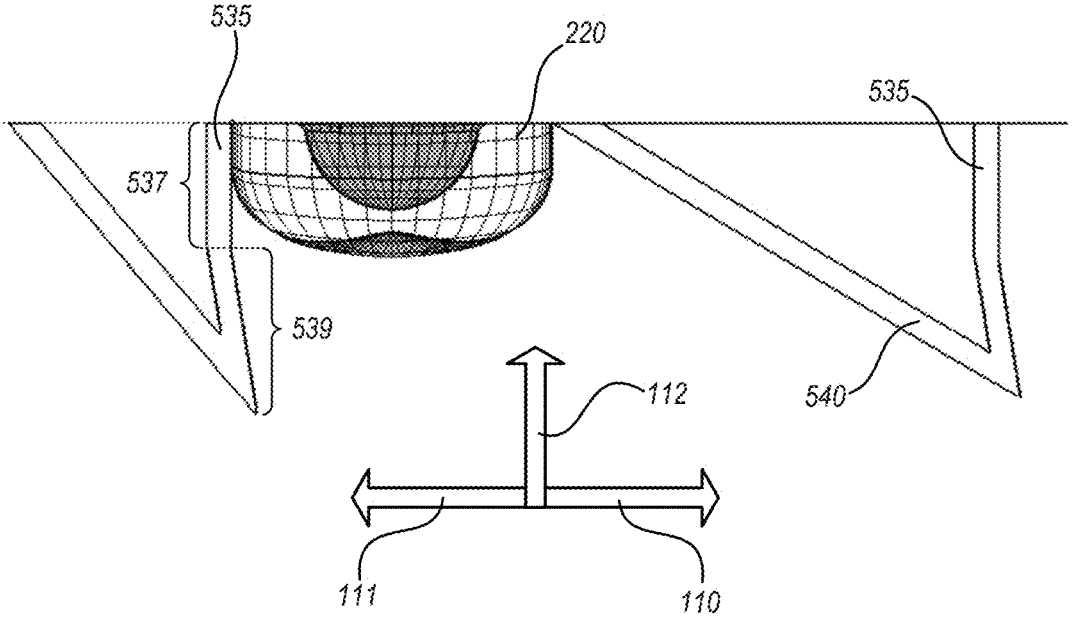
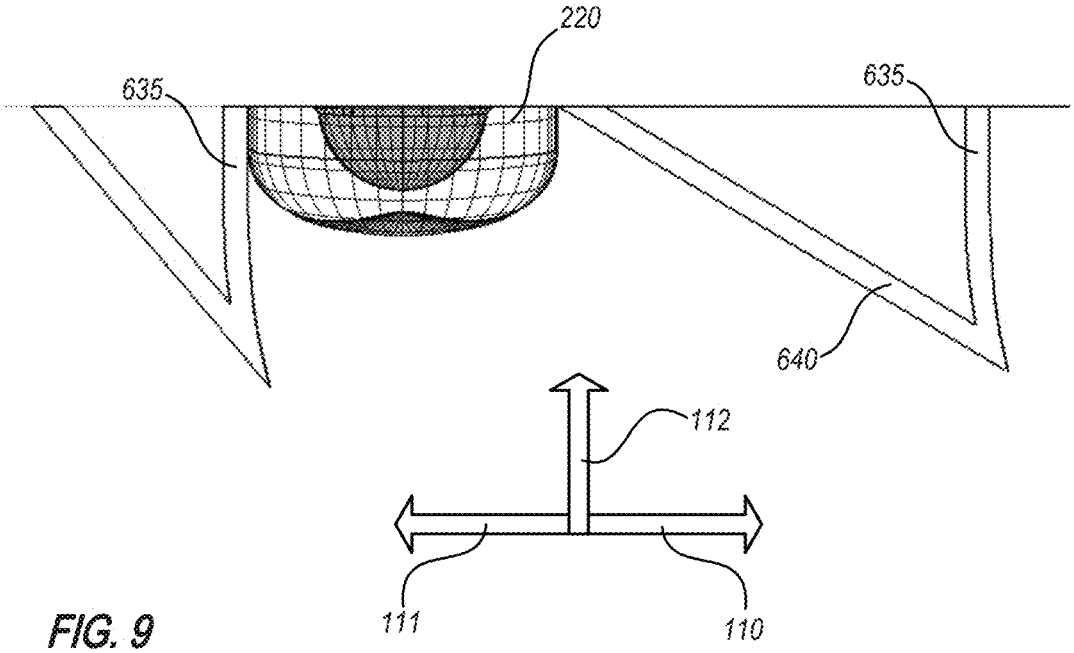
FIG. 9

ASYMMETRIC VISION ENHANCEMENT OPTICS, LUMINAIRES PROVIDING ASYMMETRIC LIGHT DISTRIBUTIONS AND ASSOCIATED METHODS

CROSS-REFERENCE TO RELATED APPLICATIONS

This application claims the benefit of U.S. Provisional Patent Application No. 62/252,938, filed Nov. 9, 2015 and entitled "Asymmetric Vision Enhancement Optics," which is incorporated herein in its entirety for all purposes.

BACKGROUND

Some lighting applications benefit from projection of an asymmetric light distribution. Benefits realized from asymmetric light distributions can include, but are not limited to, energy efficiency resulting from using all of the light emitted only where it is needed, reducing high angle glare, reducing outdoor light pollution and providing light to selected areas for aesthetic reasons. Energy efficiency and reducing outdoor light pollution, in particular, are addressed by certain emerging standards such as the Leadership in Energy and Environmental Design (LEED) standards developed by the non-profit U.S. Green Building Council. Some outdoor lighting applications are specifically designed for LEED compliance while others may benefit from similar design techniques, but are not required to meet LEED standards.

SUMMARY

In an embodiment, optics for asymmetrically redirecting light from one or more light engines toward a forward horizontal direction include a dome optic, a first reflecting surface and a second reflecting surface. A direction opposite the forward horizontal direction is defined as a backward horizontal direction. The dome optic refracts light emitted by the light engines. The first reflecting surface reflects at least a first portion of the refracted light that is initially emitted toward the backward horizontal direction, toward the forward horizontal direction. The first reflecting surface extends substantially vertically and along a transverse horizontal direction that is orthogonal to the forward horizontal direction, is proximate to the dome optic and toward the backward horizontal direction with respect to the dome optic, and has a height that is greater than or equal to a height of the dome optic. The second reflecting surface reflects downwardly at least a second portion of the refracted light that is initially emitted in the forward horizontal direction. The second reflecting surface is proximate to the dome optic and in the forward horizontal direction with respect to the dome optic, and forms an angle of 45 degrees or more with respect to vertical.

In an embodiment, a method asymmetrically redirects light from one or more light engines toward a forward horizontal direction. A direction opposite the forward horizontal direction is defined as a backward horizontal direction. The method includes emitting the light from one of the one or more light engines, refracting the light emitted by the one of the one or more light engines with a dome optic to form refracted light, and reflecting at least a first portion of the refracted light that is initially emitted toward the backward horizontal direction, from a first reflecting surface, toward the forward horizontal direction. The first reflecting surface extends substantially vertically and along a transverse horizontal direction that is orthogonal to the forward horizontal direction, is proximate to the dome optic and toward the backward horizontal direction with respect to the dome optic, and has a height that is greater than or equal to a height of the dome optic. The method further includes reflecting downwardly at least a second portion of the refracted light that is initially emitted in the forward horizontal direction, from a second reflecting surface. The second reflecting surface extends substantially in the transverse horizontal direction, is disposed in the forward horizontal direction with respect to the dome optic, and forms an angle of 45 degrees or more with respect to vertical.

In an embodiment, a luminaire provides an asymmetric light distribution biased toward a forward horizontal direction. A direction opposite the forward horizontal direction is defined as a backward horizontal direction. The luminaire includes a luminaire housing, a plurality of light engines, a plurality of dome optics, a first reflecting surface and a second reflecting surface. The light engines are coupled with the luminaire housing, arranged to emit light downwardly, and are in a row that substantially follows a transverse horizontal direction orthogonal to the forward horizontal direction. Each of the dome optics is substantially similar to each other of the dome optics and is disposed so as to refract the light emitted by at least one of the light engines to form refracted light. The first reflecting surface is coupled with the luminaire housing and reflects at least a first portion of the refracted light that is initially emitted toward the backward horizontal direction, toward the forward horizontal direction. The first reflecting surface extends substantially along the transverse horizontal direction, is proximate to each of the dome optics and toward the backward horizontal direction with respect to each of the dome optics, forms an approximately vertical angle, and has a height that is greater than or equal to a height of each of the dome optics. The second reflecting surface reflects downwardly at least a second portion of the refracted light that is initially emitted in the forward horizontal direction. The second reflecting surface extends substantially in the transverse horizontal direction, is in the forward horizontal direction with respect to the dome optics, and forms an angle of 45 degrees or more with respect to vertical.

In an embodiment, a method reconfigures a luminaire that directs light from one or more downwardly emitting light engines preferentially toward a forward horizontal direction. A direction opposite the forward horizontal direction is defined as a backward horizontal direction. The method includes detaching a first reflector assembly from the luminaire and attaching a second reflector assembly to the luminaire. The luminaire includes a luminaire housing and a plurality of light engines, each light engine being oriented to emit light in a downwardly centered distribution. The plurality of the light engines is coupled with the luminaire housing in a row that substantially follows a transverse horizontal direction orthogonal to the forward horizontal direction. The first reflector assembly and a second reflector assembly each include a first reflecting surface and a second reflecting surface. The first reflecting surface extends substantially along the transverse horizontal direction from a first region to a second region, forms an approximately vertical angle, is disposed adjacent to the plurality of the light engines in the backward horizontal direction from the light engines, and reflects at least a first portion of the light that is initially emitted toward the backward horizontal direction, toward the forward horizontal direction. The second reflecting surface extends substantially along the transverse horizontal direction from a first region to a second region, forms an angle of 45 degrees or more with respect to vertical, is disposed in the forward horizontal direction from the light engines, and reflects downwardly at least a second portion of the light that is initially emitted toward the forward horizontal direction. The first region of the first reflecting surface couples with the first region of the second reflecting surface, and the second region of the first reflecting surface couples with the second region of the second reflecting surface, to form each of the reflector assemblies. The second reflector assembly differs from the first reflector assembly in one or more of a vertical profile of the first reflecting surface, a height of the first reflecting surface, an angle of the second reflecting surface, a material of the first reflecting surface or of the second reflecting surface, a surface finish of the first reflecting surface or of the second reflecting surface, and an azimuthal curvature of the first reflecting surface.

BRIEF DESCRIPTION OF THE DRAWINGS

The present disclosure is described in conjunction with the appended figures, in which:

FIGS. 1A, 1B and 1C schematically illustrate asymmetric vision enhancement optics in side, perspective and bottom plan views, in accord with an embodiment.

FIGS. 3 and 4 schematically illustrate an array of asymmetric vision enhancement optics in side and bottom plan views, in accord with an embodiment.

FIG. 8 schematically illustrates a first reflecting surface having a different configuration, in accord with an embodiment.

FIG. 9 schematically illustrates a first reflecting surface 635 having yet another configuration, in accord with an embodiment.

DETAILED DESCRIPTION

Figure 1C:
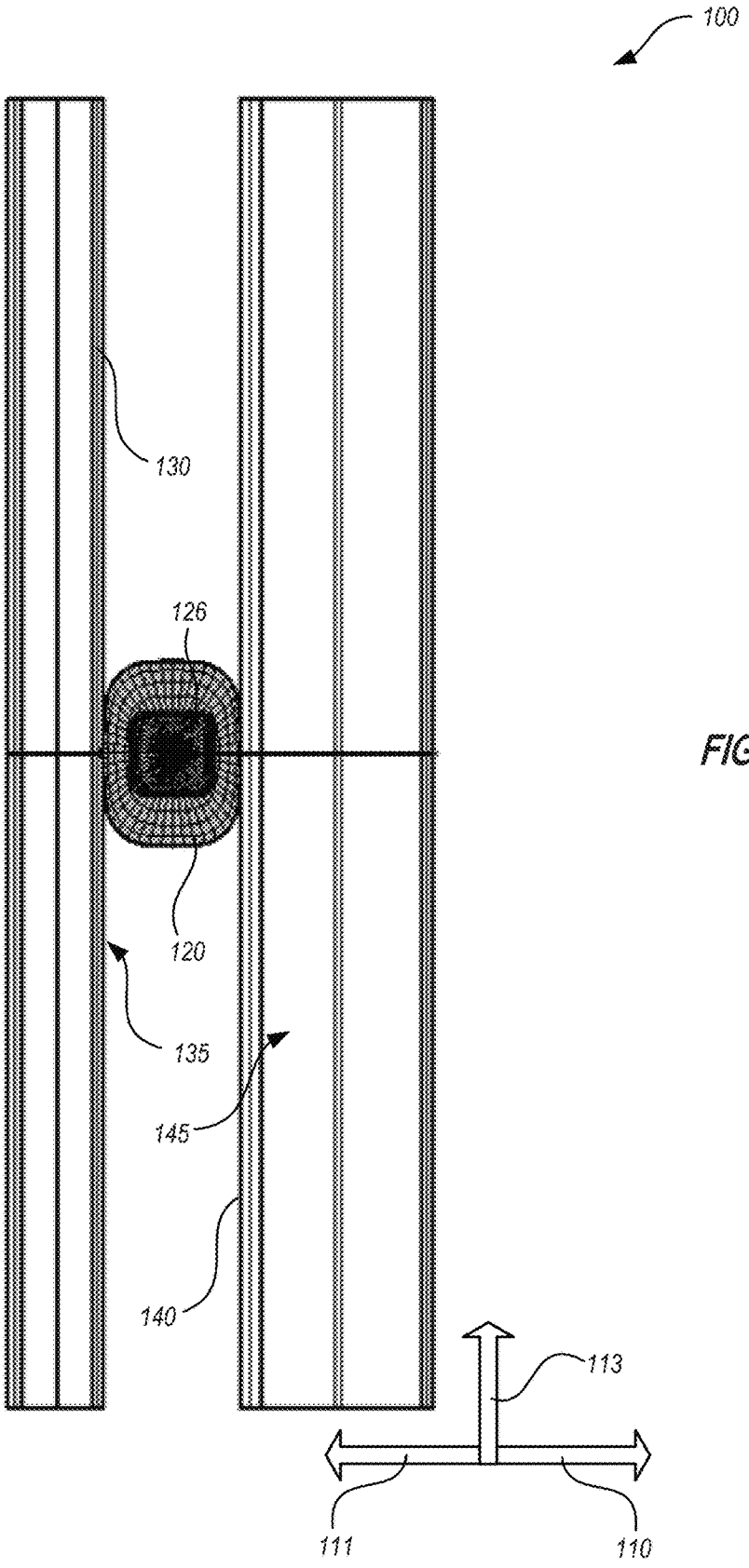

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. In instances where multiple examples of an item are shown, only some of the examples may be labeled, for clarity of illustration. Also, features that are numbered congruently across the several drawings (e.g., features numbered 1XX, 2XX, and the like) are generally similar to one another but may differ in specific disclosed details.

The present disclosure refers to a "forward horizontal direction," a "backward horizontal direction" and a "transverse horizontal direction" that are designated where needed, but other descriptions such as "up," "down," "above," "below" and the like are intended to convey their ordinary meanings in the context of the orientation of the drawings being described. However, designations such as "horizontal" and "vertical" are intended as having these meanings only within the local reference frame of the described embodiments. That is, it will be clear that optical assemblies and luminaires described herein may ultimately be mounted at angles that are not exactly horizontal or vertical.

Embodiments herein provide new and useful lighting modalities that include asymmetric vision enhancement optics. Several embodiments are contemplated and will be discussed, but embodiments beyond the present discussion, or intermediate to those discussed herein are within the scope of the present application. Asymmetric vision enhancement optics as described herein may be utilized in pole-mounted, wall-mounted and/or ceiling-mounted luminaires and may be utilized for indoor and/or outdoor lighting.

FIGS. 1A, 1B and 1C schematically illustrate asymmetric vision enhancement optics 100 in side, perspective and bottom plan views, respectively. Optics 100 include a dome optic 120 and reflecting optics 130, 140, as shown. Optics 100 are optimized to preferentially redirect light from one or more light engines 150 that initially emit light downwardly, such that the light is redirected toward a forward horizontal direction 110. A direction opposite forward horizontal direction 110 is defined as a backward horizontal direction 111. A horizontal direction that is orthogonal to forward horizontal direction is defined as a transverse horizontal direction 113. Optics 100 may also provide other light distribution and/or aesthetic advantages, as now discussed.

Light engines 150 are shown only schematically in FIGS. 1A and 1B, and are hidden above dome optic 120 in the view of FIG. 1C. Light engines 150 may be of any number or type. Dome optic 120 provides a rounded shape that spreads the light from light engines 150. As shown in FIG. 1A, dome optic 120 typically features a recess 121 into which light engines 150 initially emit light; an inner surface 122 of dome optic 120 can refract light from light engines 150 as desired. Dome optic typically includes inner surface 122, an outer surface 125 and a planar surface 124 that adjoins each of inner surface 122 and outer surface 125 around their respective peripheries. A line passing through a centroid of inner surface 122 and a centroid of outer surface 125 defines an optical axis 123, as shown in FIGS. 1A and 1B. Light engines 150 may be disposed above an upper extent of dome optic 120, as suggested in FIGS. 1A and 1B, or may be disposed within recess 121. An outer surface 125 of dome optic 120 may include a recess 126 such that outer surface 125 can refract light emitted near the optical axis outwards, to spread the light. Spreading light that would otherwise be emitted near to the optical axis helps to avoid a "hot spot" that may otherwise be generated directly under light engines 150, for example when light engines 150 are Lambertian emitters that inherently emit intense light in this direction. Although dome optic 120 is typically generated so as to provide a symmetric light distribution in cooperation with light engines 150, this is not required; that is, shapes of inner surface 122 and outer surface 125, and the positions and/or orientations of light engines 150 and dome optic 120 may be adjusted relative to one another so that a resulting light distribution is asymmetric even before effects of reflecting optics 130, 140 are considered, as discussed below. Dome optic 120 may be made of any optical material that is otherwise suitable for the environment of optics 100; typical materials for dome optic include acrylic or polycarbonate plastics, glass, and silicone.

Reflecting optics 130 and 140 are configured to direct a substantial amount of light emitted by light engines 150 and refracted by dome optic 120 toward forward horizontal direction 110. Reflecting surfaces 135 and 145 of reflecting optics 130, 140 are reflective and may be highly reflective (e.g., with polished and/or coated surfaces to achieve reflectivity exceeding 90% or 95%). Reflecting surfaces 135 and 145 are sometimes designated as first and second reflecting surfaces herein, but may also be designated in the reverse order, as well as other numbered surfaces (e.g., third, fourth etc.) when complex assemblies are described. The reflectivity characteristics of reflecting surfaces 135 and 145 may be specular or diffuse according to specific applications. Although not illustrated herein, reflecting surfaces 135 and/or 145 may also form protrusions such as ridges or bumps to further diffuse light reflecting therefrom, or for aesthetic interest. Reflecting optics 130 and 140 may be formed of any material that is capable of being finished with surfaces having the reflectivity characteristics for a given application. In particular, reflecting optics 130, 140 may be formed of acrylic or polycarbonate and subsequently metalized (on at least portions of reflecting surfaces 135, 145) or may be formed of metal, at least portions of which are polished, painted or the like to provide desired reflectivity.

A portion of light will emit downwards from dome optic 120 and without interacting with reflecting optics 130, 140, while other portions of light will reflect from reflecting surfaces 135 and 145. Although reflecting optics 130, 140 are shown as having an approximately V-shaped profile in FIGS. 1A and 1B, the discussion below will clarify that reflecting optics 130, 140 can take different forms.

Reflecting surface 135 is disposed proximate to, and in embodiments may touch, the side of dome optic 120 that faces backward horizontal direction 111, as shown. Reflecting surface 135 is reflective so as to redirect light thereon toward the forward horizontal direction. Because reflecting surface is behind dome optic 120, the light thus redirected is originally emitted away from the forward horizontal direction and is redirected toward the forward horizontal direction. Reflecting surface 135 extends substantially in transverse horizontal direction 113, and is typically a planar surface oriented at a vertical angle, as shown in FIGS. 1A and 1B, but can be curved and/or oriented at other angles, in embodiments.

For example, in certain embodiments reflecting surface 135 forms a "kicker" shape by tilting such that a lower edge of surface 135 is more in the forward horizontal direction 110 than an upper edge of surface 135. In other embodiments an upper portion of surface 135 forms a first angle, while a lower portion of surface 135 forms a second angle by deviating from the first angle by extending further forward at the lower edge. In still other embodiments, part or all of surface 135 curves slightly so as to form a concave shape with respect to light engine 150, again with the lower edge of surface 135 more in the forward horizontal direction 110 than the upper edge of surface 135. Any or all of such variations on shape and angle of reflecting surface 135 are considered herein to form an "approximately vertical angle" as long as a net angle of reflecting surface 135, measured from its upper edge to its lower edge, is within 15 degrees from vertical.

The portion of reflecting optic 130 that angles upwardly from the low point of reflecting surface 135 and away from dome optic 120 is structural and can have any shape, except that when reflecting optic 130 is disposed between dome optics 120, that portion may form a reflecting surface 145 for an adjacent dome optic 120, as discussed further below. Reflecting surface 135 has a height H2 that is at least as great as a height H1 of dome optic 120 (e.g., reflecting surface 135 extends at least as far as dome optic 120 in vertical direction 112). In embodiments, reflecting surface 135 has a height H2 that is twice height H1 of dome optic 120, so as to block a substantial amount of light emitted at high angles from dome optic 120, and redirect that light toward the forward horizontal direction, so as to keep the same reflected light from escaping as high angle rays in backward horizontal direction 111. This minimizes glare to a viewer that is located below and toward backward horizontal direction 111, relative to asymmetric optics 100.

Reflecting surface 145 may be disposed near to, and may touch, the side of dome optic 120 that faces forward horizontal direction 110, but reflecting surface 145 may also be located at a distance from dome optic 120. Reflecting surface 145 is also reflective, but is angled at an angle $\phi$ of at least 45 degrees from vertical, as shown. Angle $\phi$ being at least 45 degrees from vertical ensures that the reflected light does not reflect strongly away toward backward horizontal direction 111, but instead reflects generally downward. Typical angles for $\phi$ are 45 degrees or greater, so that light reflected from surface 145 is downward and either has no horizontal component away from forward horizontal direction 110, or has a horizontal component in forward horizontal direction 110. $\phi$ can advantageously be about 50 to 80 degrees, so that the reflected light continues to have a substantial horizontal component along forward horizontal direction 110, while also reflecting downward. Reflecting surface 145 is also at least as tall as dome optic 120 in the vertical direction, and is typically about twice as tall as dome optic 120 to at least block and redirect some high angle light in the forward horizontal direction 110, although angle $\phi$ causes this effect to be less pronounced in the forward horizontal direction 110 than the effect of reflecting surface 135 away from the forward horizontal direction 110.

Both reflecting surfaces 135 and 145 extend substantially in the transverse horizontal direction, but certain embodiments feature variations on the straight line profiles shown in FIGS. 1A, 1B and 1C. For example, in some embodiments first reflecting surface 135 curves azimuthally so as to form a curve that is concave with respect to one or more of light engines 150. This causes reflections from reflecting surface 135 to converge; radius of curvature of first reflecting surface 135 can be arranged so as to generate a nearby or distant convergence. Past a point of convergence, the light thus reflected will diverge. Such curvatures may be formed about individual ones of light engines 150 or about groups of light engines 150. Such curvatures may also be asymmetric in that light may be directed preferentially toward one side (e.g., in or out of the plane of FIG. 1A, 1B, or up or down in the view of FIG. 1C). Similarly, in certain embodiments first reflecting surface 135 curves azimuthally so as to form a curve that is convex with respect to one or more of light engines 150. This causes reflections from reflecting surface 135 to diverge.

In addition to light that interacts with reflecting surfaces 135, 145 as described above, a substantial portion of the light from light engines 150 emits generally downwardly from dome optic 120 without touching either of reflecting surfaces 135, 145. This portion of light, in addition to some portions of the light reflected by surfaces 135, 145 may generate a relatively concentrated area of light immediately below dome optic 120. An overall photometric distribution resulting from the combination of light engines 150, dome optic 120 and reflecting surfaces 135, 145 may thus be highly concentrated below dome optic 120, have a small component in backward horizontal direction 111 and have a substantial component along forward horizontal direction 110. In an embodiment, asymmetric optics 100 are disposed in a pole-mounted luminaire, and the relationships, angles and the like discussed above can be arranged such that light emitted from asymmetric optics 100 is concentrated within an area bounded by a horizontal distance that is about twice the mounting height of the luminaire, with less light outside of that distance. Thus, asymmetric optics 100 may be particularly suitable for applications such as small parking lots where opportunities to mount luminaires are generally found around the periphery of the parking lot, and the most desirable area(s) for light distribution are directly under the luminaires and towards the parking lot, but not outside the parking lot.

As may be appreciated from reading and understanding the description above and by reviewing FIGS. 1A, 1B and 1C, asymmetric optics 100 can form repeating structures such that light from multiple light engines 150 can be directed in a similar fashion, that is, generally toward forward horizontal direction 110 and blocking high angle rays propagating toward backward horizontal direction 111. In particular, reflecting surfaces 135 and 145 can be provided on a single V-shaped member that is disposed between adjacent light engines 150. Furthermore, multiple light engines 150 may be provided in rows that extend along the transverse horizontal direction 113, interspersed with reflecting optics 130/140 that extend along the same direction, such that light from entire arrays of light engines 150 can be redirected (see, for example, FIG. 4).

Figure 2A:
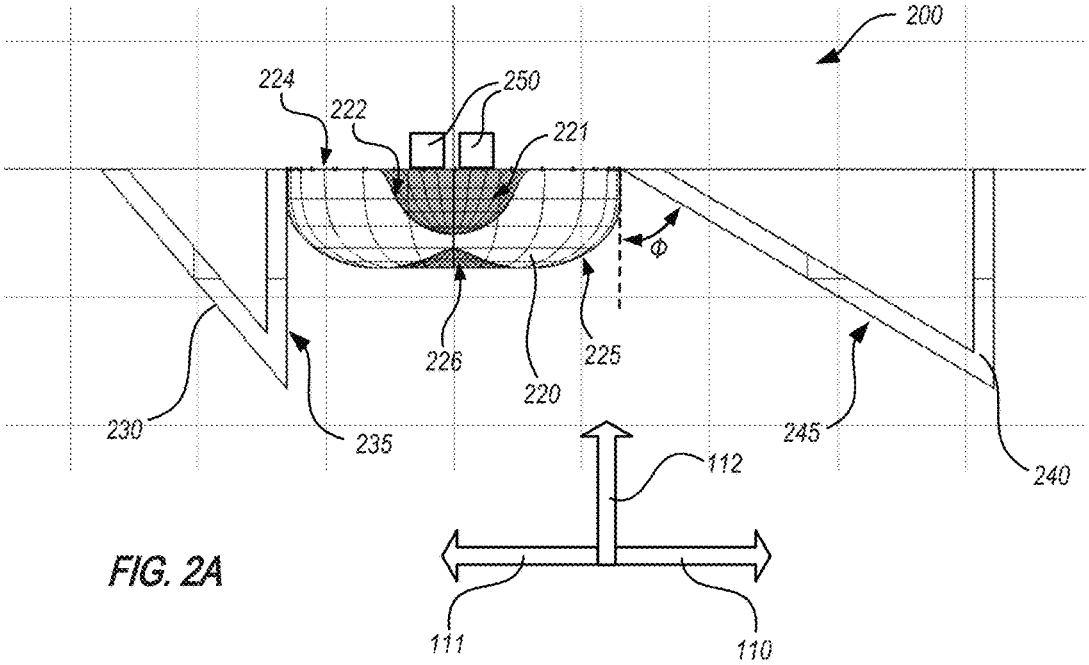
FIGS. 2A and 2B schematically illustrate asymmetric vision enhancement optics in side views, in accord with an embodiment.
Figure 2B:
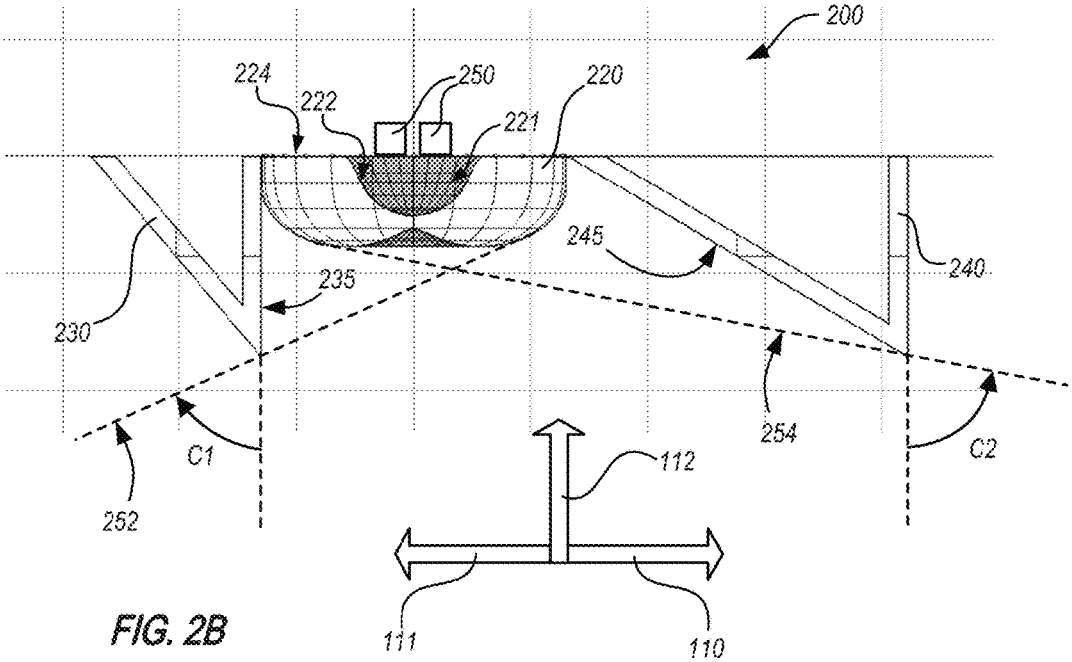

FIG. 2A schematically illustrates asymmetric vision enhancement optics 200 in a side view, in accord with another embodiment. FIG. 2B schematically illustrates asymmetric vision enhancement optics 200 in another side view that is scaled and has modified reference indicia relative to FIG. 2A. In FIG. 2B, broken lines 252 and 254 indicate first and second cutoff angles C1 and C2 respectively, formed by optics 200. Each cutoff angle is defined as an angle from vertical, below which some part of dome optic 220 is visible past corresponding first reflecting surface 235 or second reflecting surface 245. Above the cutoff angles, the corresponding surfaces block any view of dome optic 220. The proximity of first reflecting surface 235 to dome optic 220 and the distance between the lower edge of second reflecting surface 245 from dome optic 220 may result in cutoff angle C1 being closer to vertical than cutoff angle C2. In the example shown, C1 is about 66 degrees while C2 is about 79 degrees. Cutoff angles C1 and C2 can be modified by varying the height of dome optic 220 and/or the height of reflecting surfaces 235, 245.

FIGS. 3 and 4 schematically illustrate an array 300 of asymmetric vision enhancement optics in side and bottom plan views. Array 300 includes multiple instances of dome optics 320 and reflecting optics 330, held in place by structure 360. Array 300 preferentially redirects light from light engines 350 that initially emit light downwardly, such that the light is redirected toward forward horizontal direction 110. Array 300 features light engines 350 and corresponding dome optics 320 disposed in rows along transverse horizontal direction 113, interspersed with reflecting optics 330 which extend along the rows; thus a single cross-section such as shown in FIG. 3 includes at least a first light engine 350 and dome optic 320, surrounding reflecting optics 330, a second light engine 350 and dome optic 320, surrounding reflecting optics 330, and so on. Array 300 may also provide other light distribution and/or aesthetic advantages, as now discussed.

FIG. 3 shows two light engines 350 associated with each dome optic 320, but it is understood that any number or type of light engines 350 may be utilized. Similar to optics 100 described above, dome optics 320 spread the light from light engines 350, while reflecting optics 330 direct a substantial amount of light emitted by light engines 350 and refracted by dome optics 320, downwardly and/or toward forward horizontal direction 110. Reflecting optics 330 are arranged as ridges, with each dome optic 320 being disposed adjacent to a reflecting vertical face of one ridge (similar to reflecting surface 135, FIGS. 1A-1C) and also adjacent to a reflecting, sloping face of an adjacent ridge (similar to reflecting surface 145, FIGS. 1A-1C). Although three dome optics 320 and their associated light engines 350 are shown adjacent to each ridge in FIG. 4, this is merely to illustrate the concept of disposing multiple dome optics and light engines adjacent to each such ridge; any number of dome optics and light engines may be thus placed. Light from light engines 350 is thus refracted by dome optics 320 and redirected preferentially toward forward horizontal direction 110. High angle rays from dome optics 320 that initially propagate away from forward horizontal direction 110 are instead blocked and redirected by the vertical faces of reflecting optics 330, reducing high angle glare away from forward horizontal direction 110. The same material and surface finish choices as described above for reflecting optics 130, 140 apply to reflecting optics 330. Structure 360 can be formed of any material that will provide appropriate structural support for array 300. In certain embodiments, structure 360 is fabricated as a frame rather than with solid panels, such that the frame tends to allow light to pass through at most locations. In other embodiments, structure 360 may be fabricated of solid panels that may, like reflecting optics 330, be provided with reflecting surfaces to help direct light from array 300 toward forward horizontal direction 110 or toward other desired directions.

Although FIG. 4 shows reflecting optics 330 as straight ridges (e.g., straight vertical ridges in the orientation of FIG. 4) it is contemplated that reflecting optics 330 can form curved ridges, in embodiments. This allows customization of a fixture incorporating arrays of reflecting optics 330 for applications where an environment of use may benefit (in terms of light distribution, aesthetic appearance or both) from use of fixtures that incorporate such curved ridges. Optics 330 may form curves that are convex with respect to forward horizontal direction 110 (e.g., aiming light at extreme edges of the fixture in an outwardly fanned manner) or concave with respect to forward horizontal direction 110 (e.g., aiming light at extreme edges of the fixture in an inwardly fanned or concentrated manner).

Figure 5:
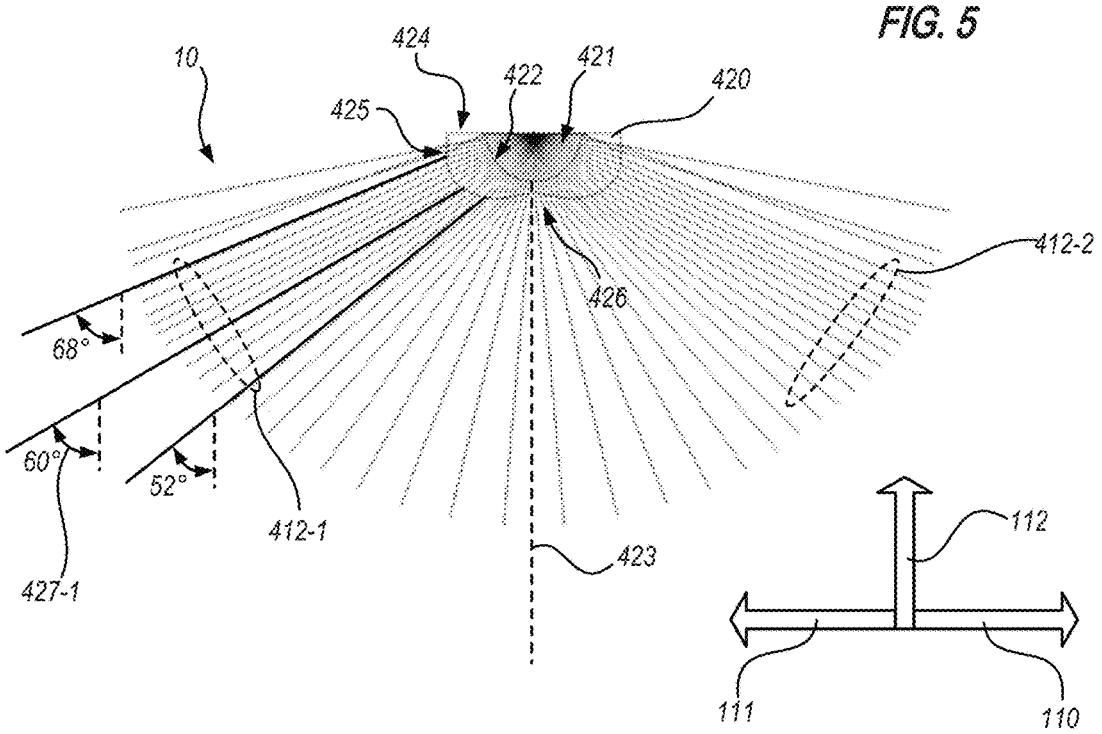
FIG. 5 schematically illustrates certain properties of an embodiment of a dome optic, in accord with an embodiment.

FIG. 5 schematically illustrates certain properties of an embodiment of a dome optic 420, which may be any of the dome optics 120, 220, 320 shown in previous drawings. The view illustrated in FIG. 5 is a cross-section in the forward-backward horizontal direction, like the cross-sections shown in FIGS. 1A, 2A and 2B. Representative light rays 10 are shown emanating from a point at a center of lens cavity 421 of dome optic 420, but this is not a requirement; light engines of embodiments herein may be any of point sources, area sources or multiple sources. An inner surface 422 of dome optic 420 has a profile that is substantially hemispherical, although this too is not required. A planar surface 424 is perpendicular to an optical axis 423 that passes through a centroid of inner surface 422 and an outer surface 425. Outer surface 425 extends further from cavity 421 on either side, in the view of FIG. 5, so as to act as a lens, providing regions of concentrated light rays 412-1, 412-2. Light rays 412 emerge at substantially similar angles, which helps control a photometric distribution of a luminaire utilizing dome optic 420. In embodiments, light within the region of light concentration typically refracts so as to emerge within a range of ±10 degrees from a light concentration angle 427 that characterizes the region. For example, in FIG. 5, light concentration angle 427-1 is 60 degrees from vertical, and the range of light rays 412 emerging from dome optic 420 is from 52 to 68 degrees from vertical. Some light exits dome optic 420 around optical axis 423, but recess 426 provides a change of slope in outer surface 425 that refracts the light around the optical axis away from the optical axis, so that a bright spot along optical axis 423 is minimized. Outer surface 425 and inner surface 422 are each symmetrical along each of the forward and transverse horizontal directions, but are different from one another. These symmetries generate a photometric distribution from dome optic 420 when a light source is centered therein, that is also symmetrical in each of the forward and transverse horizontal directions. Such symmetry is not required, but can help simplify optical modeling and tooling generation for manufacturing dome optic 420.

Figure 6:
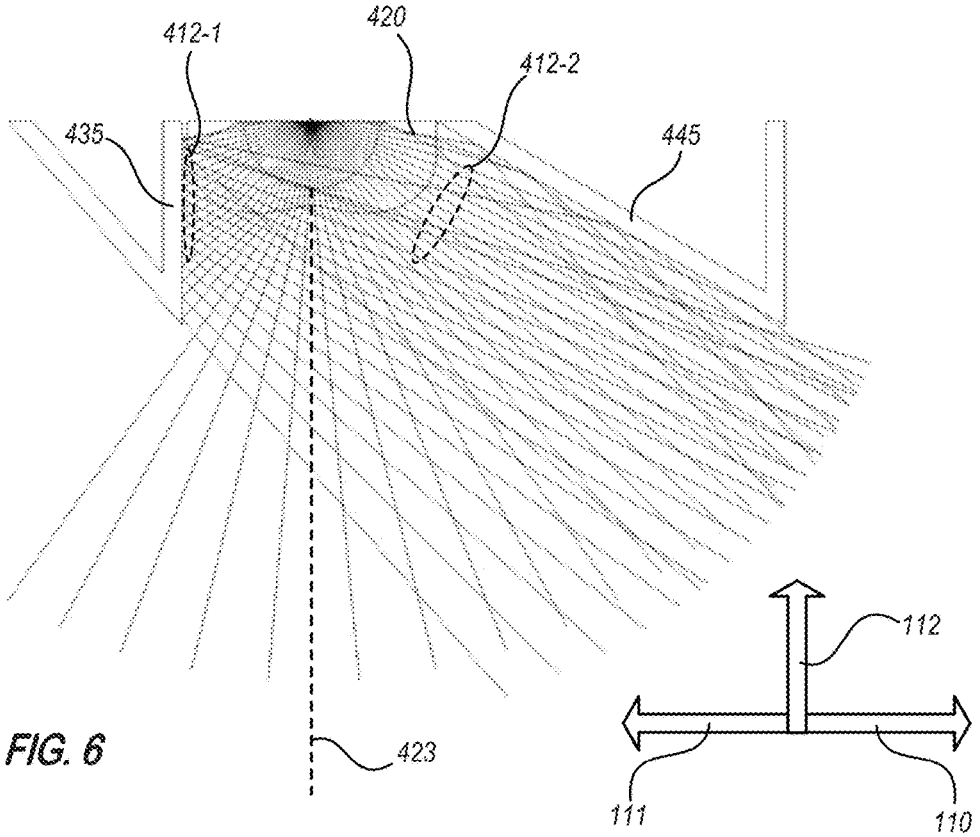
FIG. 6 schematically illustrates optical performance of the dome optic of FIG. 5 when first and second reflecting surfaces are added, in accord with an embodiment.

FIG. 6 schematically illustrates optical performance of dome optic 420 when first and second reflecting surfaces 435, 445 are added. Light rays 412-1 on the backward side of dome optic 420 reflect from first reflecting surface 435 and are redirected toward forward horizontal direction 110. Some of light rays 412-2 on the forward side of dome optic 420 reflect downwardly from second reflecting surface 445, while other light rays 412-2 pass under second reflecting surface 445. Thus, much more of light emerging from dome optic 420 is eventually directed toward forward horizontal direction 110 than backward horizontal direction 111. As noted in connection with FIG. 5, the slope of outer surface 425 caused by recess 426 refracts light away from optical axis 423, minimizing a bright spot along optical axis 423, and light in this area typically does not interact with first or second reflecting surfaces 435, 445.

Figure 7A:
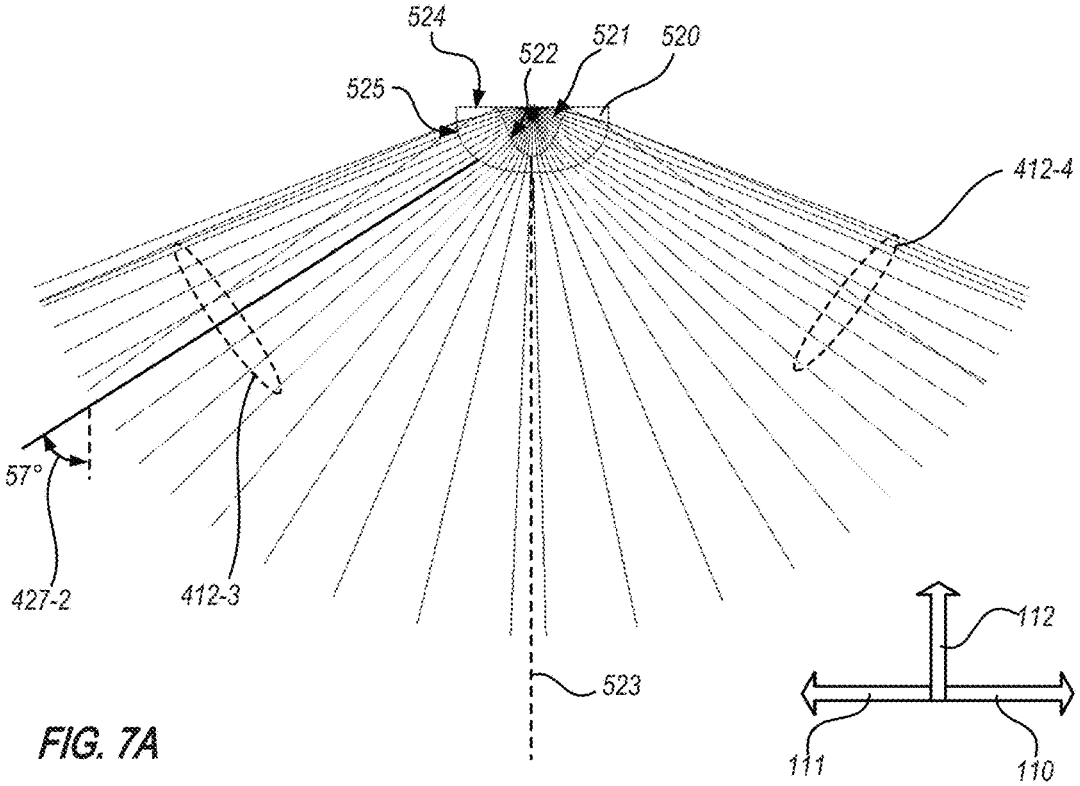
FIGS. 7A and 7B schematically illustrate optical performance of a dome optic that may be used in embodiments.
Figure 7B:
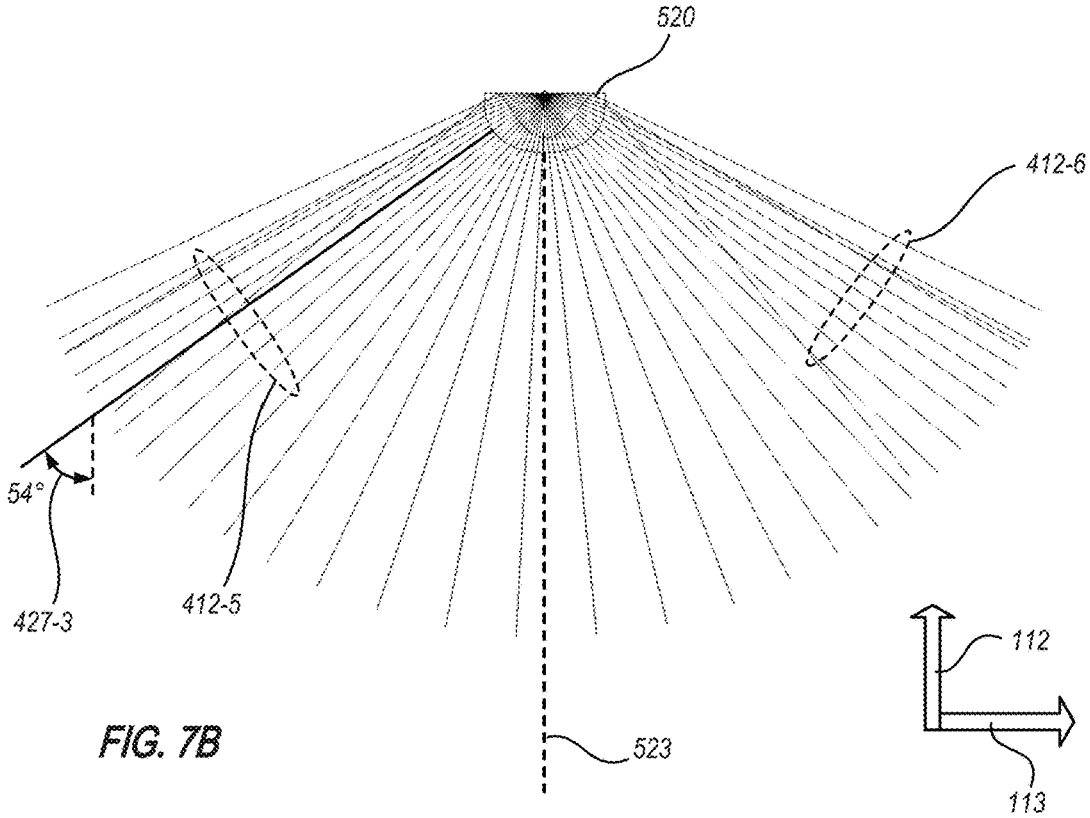

FIGS. 7A and 7B schematically illustrate optical performance of a dome optic 520 that may be used in embodiments. Similar to dome optic 420, dome optic 520 includes an inner surface 522, an outer surface 525, a planar surface 524 that adjoins each of surfaces 522 and 525 about their respective peripheries. Planar surface 524 is perpendicular to an optical axis 523 that passes through centroids of inner surface 522 and outer surface 525. Outer surface 525 and inner surface 522 are each symmetrical along each of the forward and transverse horizontal directions, but are different from one another. Also similar to dome optic 420, dome optic 520 provides regions of concentrated light rays, shown as 412-3, 412-4, 412-5 and 412-6 in FIGS. 7A, 7B. Each group of light rays 412 emerges at substantially similar angles, which helps control a photometric distribution of a luminaire utilizing dome optic 520. It can be seen that light rays 412-3 are at angles that center about an angle of 57° from vertical, while light rays 412-5 are at angles that center about an angle of 54° from vertical, demonstrating that profiles of surfaces 522 and 525 may be different along each of the forward and transverse horizontal directions while still being symmetric about those directions.

FIG. 8 schematically illustrates a first reflecting surface 535 having a different geometry than reflecting surfaces 135, 235 and 435. An upper portion 537 of first reflecting surface 535 is planar and forms an upper portion angle, which is vertical as shown in FIG. 8, but other angles close to vertical are also possible. A lower portion 539 of first reflecting surface 535 is also planar but forms a lower portion angle that deviates from the upper portion angle by extending in the forward horizontal direction at its lower edge. The slight change of angle in lower portion 539 relative to portion 537 can significantly boost the quantity of light that is reflected toward the forward horizontal direction, raise the angle of some of the reflected light relative to vertical, and increase cutoff angle, to provide a more asymmetric light distribution. FIG. 9 schematically illustrates a first reflecting surface 635 having yet another configuration, in which an upper portion is planar and a lower portion curves, achieving a similar effect as first reflecting surface 535. The angles, straightness and/or curvature of upper portion 537 and lower portion 539 of first reflecting surface 535, and of first reflecting surface 635, may all be considered attributes of vertical profiles of such reflecting surfaces.

Upon reading and comprehending the present disclosure, one of ordinary skill in the art will readily recognize many alternatives, modifications and equivalents to the structures shown in FIGS. 8 and 9. In one important example, it may be seen that sloping reflectors 540 and 640 shown in FIGS. 8 and 9 respectively can also form multiple angled segments and/or curves like those illustrated for reflecting surfaces 535 and 635.

Figure 10A:
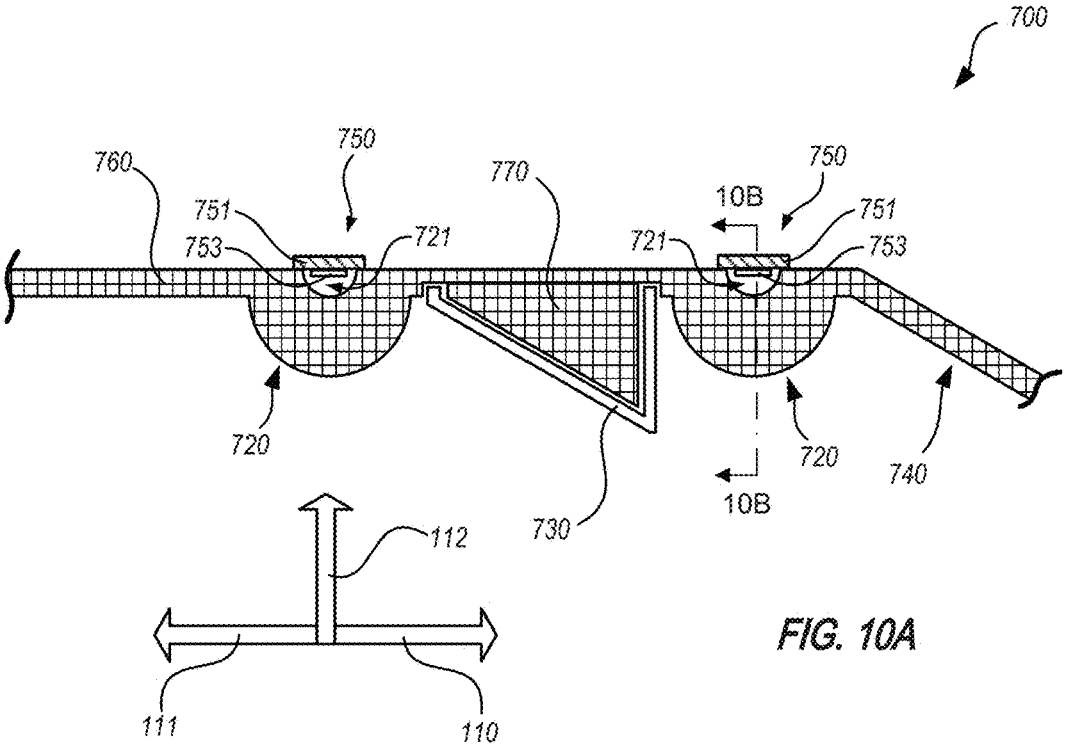
FIGS. 10A and 10B schematically illustrate certain features of a portion of a luminaire that includes light engines emitting light into and through a structural plate, in accord with an embodiment.
Figure 10B:
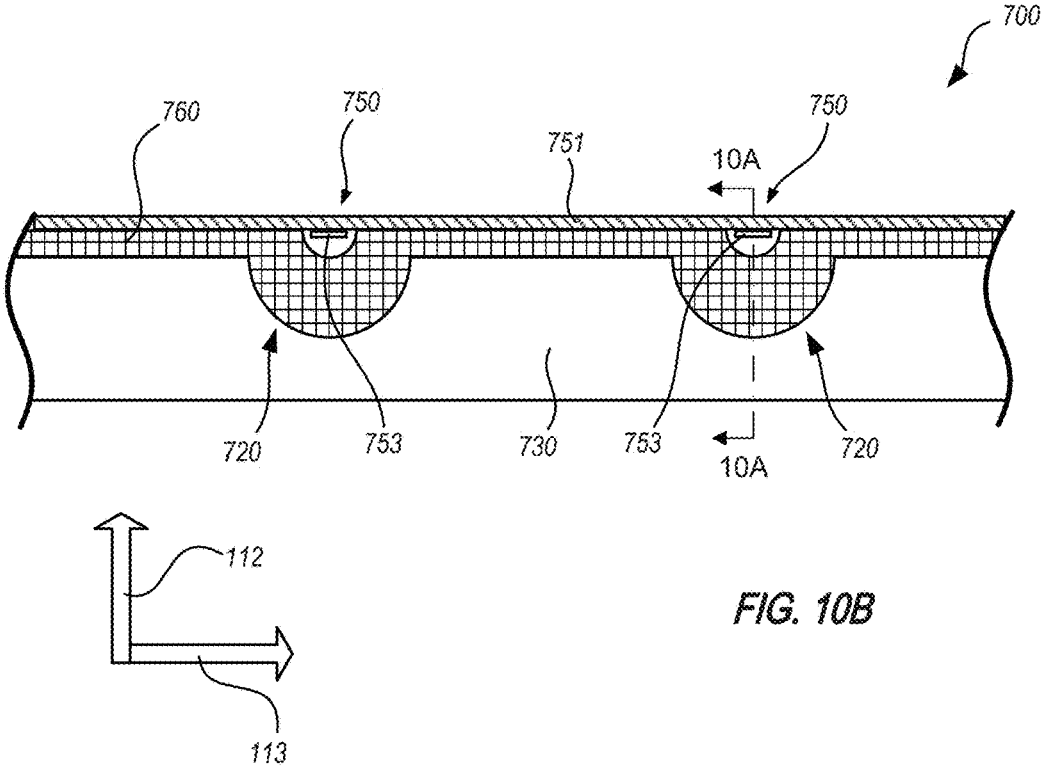

FIGS. 10A and 10B schematically illustrate certain features of a portion 700 of a luminaire that includes light engines 750 emitting light into and through a structural plate 760. In portion 700, light is at least partially shaped by asymmetric vision enhancement optics in the form of one or more removable reflectors 730 and dome optic portions 720. FIG. 10B is a view taken at a plane marked 10B-10B in FIG. 10A, and FIG. 10A is a view taken at a plane marked 10A-10A in FIG. 10B. Structural plate 760 may be fabricated for example of one or more optical materials such as acrylic, polycarbonate, glass and/or silicone, and may provide several advantages. For example, structural plate 760 may provide not only structural support but optical elements such as recesses 721, dome optic portions 720 and reflecting surface 740, as shown. Various surface portions of structural plate 760 may be provided with a clear finish for highest optical throughput, a matte finish to provide translucency with some diffusion of light propagating therethrough, reflective coatings such as paint or vacuum metallization, and/or opaque materials for absorbing stray light, as required.

Integration of such optical elements into structural plate 760 may reduce manufacturing cost and improve final product quality, as compared to providing and assembling such elements in individual form. Optical elements such as optics and reflectors will often be manufactured in the same way that structural plate 760 is manufactured (typically, for example, by injection molding or casting). Because the amount of optical material is relatively small, the manufacturing cost is primarily driven by tooling and operational costs of manufacturing equipment, so a single structural plate 760 will generally cost less than a total cost of its individual elements manufactured separately. Manufacturing structural plate 760 as a unit also reduces assembly cost associated with putting multiple elements together, and may reduce manufacturing tolerances associated with positioning of multiple elements. One skilled in the art will observe that many embodiments herein can use the techniques demonstrated in FIGS. 10A and 10B to provide multiple optical elements. In particular, one or more structural plates 760 that are formed as strips and include multiple dome optic portions 720, can be economically assembled to a printed circuit board (PCB) 751 having light sources 753 mounted thereto, to form rows or grids of light engines that are integrated with corresponding optics.

Removable reflector 730 provides a user-replaceable optic that can, for example, be installed or removed as luminaire portion 700 is assembled, or replaced at a later time (e.g., as a retrofit option). Removable reflector 730 may be fabricated of any material that can be provided with a desired reflectivity; for example, metalized plastic (e.g., acrylic, polycarbonate) or polished metal can be used to provide highly reflective surfaces, while opaque plastics or painted metal may also be useful in embodiments. An optional backing structure 770 may also be provided for additional structural support of removable reflector 730. A single instance of removable reflector 730 and backing structure 770 can be provided with luminaire portion 700, or multiple instances may be provided.

Removable reflector 730 (and optionally, backing structure 770) can be added, removed and/or reversed (e.g., with backing structure 770 and the sloping face of removable reflector 730 sloping towards or away from forward horizontal direction 110) as desired to adjust the overall light distribution from luminaire portion 700. This provides a degree of freedom to the installer and/or user of a generic luminaire that incorporates luminaire portion 700 to customize the light distribution of the luminaire for a given installation, or to alter the light distribution of an installed luminaire based on changing needs at the installed location.

FIGS. 10A and 10B also show certain details within light engines 750. In FIGS. 10A and 10B, each light engine 750 includes at least a portion of a printed circuit board (PCB) 751 with a light-emitting diode (LED) 753 mounted thereon. Both PCB 751 and light source 753 are exemplary only; one of ordinary skill in the art will readily recognize many alternatives, modifications and equivalents. PCB 751 typically mounts flush to one or more adjacent surfaces, such as structural plate 760. Each light source 753 may include one or more packaged or unpackaged LED chips or other types of light sources, including LED chips that are packaged as a group (e.g., so-called chip-on-board (COB)) light sources. PCBs 751 may form parts of individual or multiple light engines 750; for example, FIG. 10B shows how a luminaire may include a single PCB 751 that extends across multiple light engine 750 locations, with particular light sources 753 at the light engine locations.

FIGS. 11 through 18 schematically illustrate various construction modalities of embodiments herein. Although many such modalities are explicitly illustrated, alternatives, intermediate constructions, modifications and equivalents will be evident to one of ordinary skill in the art upon reading and comprehending the present disclosure, and are considered within the scope of the disclosure.

Figure 11:
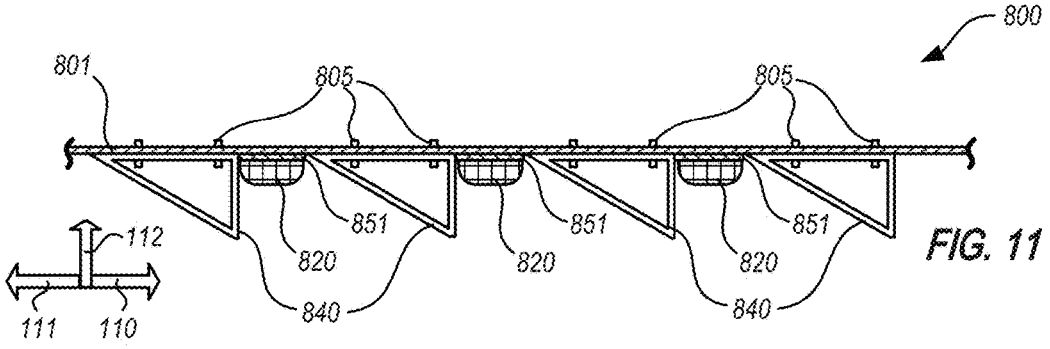
FIG. 11 illustrates a luminaire portion that includes a structural support, with which reflectors, light engines and dome optics are coupled, in accord with an embodiment.

FIG. 11 illustrates a luminaire portion 800 that includes a structural support 801, with which reflectors 840, light engines and dome optics 820 are coupled. Reflectors 840 couple with structural support 801 using fasteners 805. Fasteners 805 may be permanent (e.g., rivets) or removable and replaceable (e.g., snaps, tabs, bolts, screws and the like) and are not limited to the number and placement of fasteners 805 illustrated in FIG. 11. Reflectors 840 may form closed cross-sectional shapes, as shown, or may be open shapes (e.g., see FIG. 12). Reflectors 840 are not limited to the profiles shown in FIG. 11, but may include angled and/or curved surfaces, such as shown in FIGS. 8 and 9. Fasteners 805 secure reflectors 840 to structural support 801. Each light engine includes a PCB 851, shown between structural support 801 and each dome optic 820, and a light source (e.g., an LED or other light source) that receives power through PCB 851 and is hidden within a cavity of dome optic 820 in the view of FIG. 11. Each dome optic 820 may, but is not required to, form flat surfaces that abut and/or seal against PCB 851 in order to protect a light source within a cavity of the dome optic. Dome optics 820 may be manufactured and installed individually, or in integrated strips, as discussed above in connection with FIGS. 10A and 10B.

Figure 12:
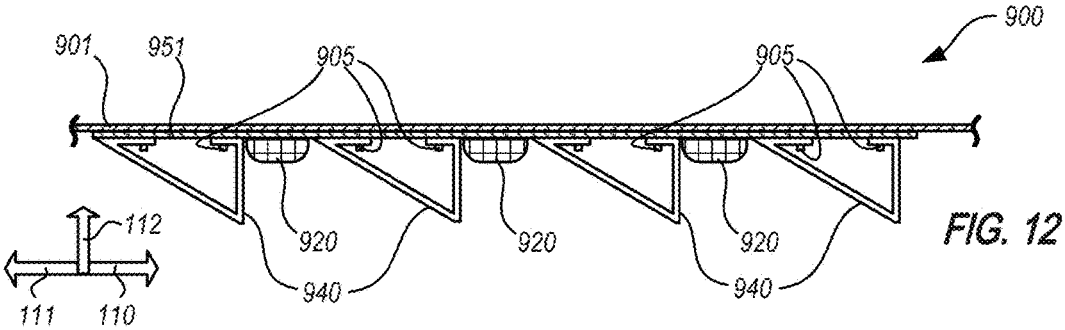
FIG. 12 illustrates a luminaire portion that is similar to the luminaire portion of FIG. 11, but including a common printed circuit board (PCB), in accord with an embodiment.

FIG. 12 illustrates a luminaire portion 900 that is similar to portion 800 shown in FIG. 11, but luminaire portion 900 includes a common PCB 951 that provides connectivity for all light engines of portion 900 (which light engines are hidden within dome optics 920). In luminaire portion 900, fasteners 905 attach both reflectors 940 and PCB 951 to structural support 901, and fasteners 905 may be, for example, tabs that are punched from the material forming structural support 901 that are bent so as to pass through holes in PCB 951 and reflectors 940, then crimped to secure PCB 951 and reflectors 940 against structural support 901. Fasteners 905 may be either permanent or removable and replaceable, and are not limited to the number and placement of fasteners illustrated in FIG. 12. Reflectors 940 may include angled and/or curved surfaces, such as shown in FIGS. 8 and 9, and dome optics 920 may form flat surfaces that abut and/or seal against PCB 951. Dome optics 920 may be manufactured and installed individually, or in integrated strips, as discussed above in connection with FIGS. 10A and 10B.

Figure 13:
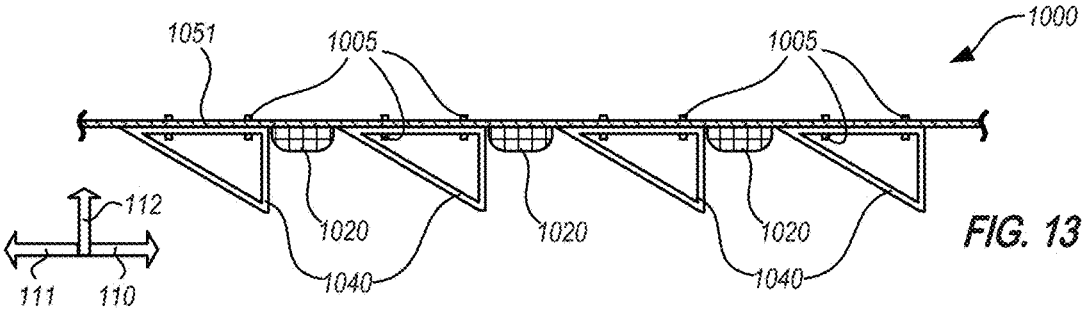
FIG. 13 illustrates a luminaire portion that is similar to the luminaire portions of FIGS. 11 and 12, but without a structural support element, in accord with an embodiment.

FIG. 13 illustrates a luminaire portion 1000 that is similar to portions 800 and 900 shown in FIGS. 11 and 12, but luminaire portion 1000 does not include a structural support element such as 801, 901. Instead, PCB 1051 obtains support outside of the region shown in FIG. 13, that is, either in an alternate cross-sectional plane or beyond the region limited by the breaks shown. PCB 1051 provides connectivity for all light engines of portion 1000 (which light engines are hidden within dome optics 1020), and dome optics 1020 may form flat surfaces that abut and/or seal against PCB 1051. Type, number, location and/or removability or replaceability of fasteners 1005 may be similar to the like characteristics of fasteners 805, 905 discussed above. Reflectors 1040 may include angled and/or curved surfaces, such as shown in FIGS. 8 and 9. Dome optics 1020 may be manufactured and installed individually, or in integrated strips, as discussed above in connection with FIGS. 10A and 10B.

Figure 14:
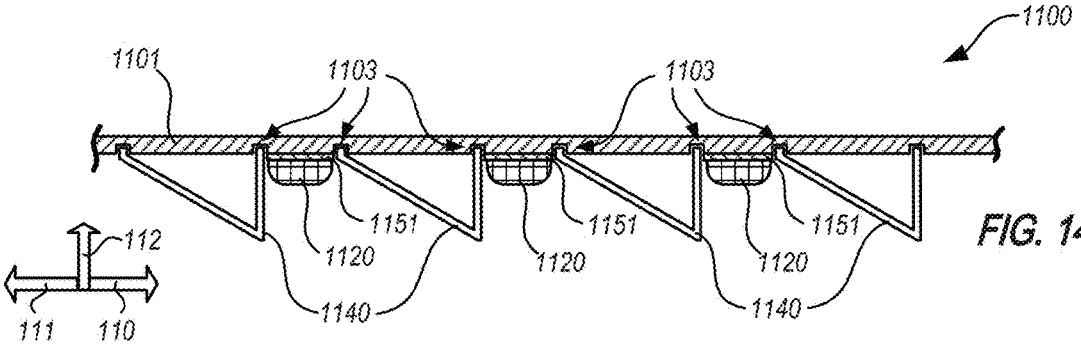
FIG. 14 illustrates another luminaire portion, in accord with an embodiment.

FIG. 14 illustrates a luminaire portion 1100 that is similar to portions 800, 900 and 1000 shown in FIGS. 11, 12 and 13. In luminaire portion 1100, structural support 1101 forms recesses 1103 into which reflector sections 1140 couple. Reflector sections 1140 may snap into recesses 1103, form an interference fit therewith, and/or fasten using fasteners (e.g., like fasteners 805, 905, 1005 shown in FIGS. 11, 12 and 13). Coupling reflector sections 1140 with recesses 1103 with a snap or interference fit may be particularly advantageous for luminaires that are intended to be customizable by an end user. PCBs 1151 provide connectivity for light engines of portion 1100 (which light engines are hidden within dome optics 1120), and dome optics 1120 may form flat surfaces that abut and/or seal against PCBs 1151. Reflector sections 1140 may include angled and/or curved surfaces, such as shown in FIGS. 8 and 9. Dome optics 1120 may be manufactured and installed individually, or in integrated strips, as discussed above in connection with FIGS. 10A and 10B.

Figure 15:
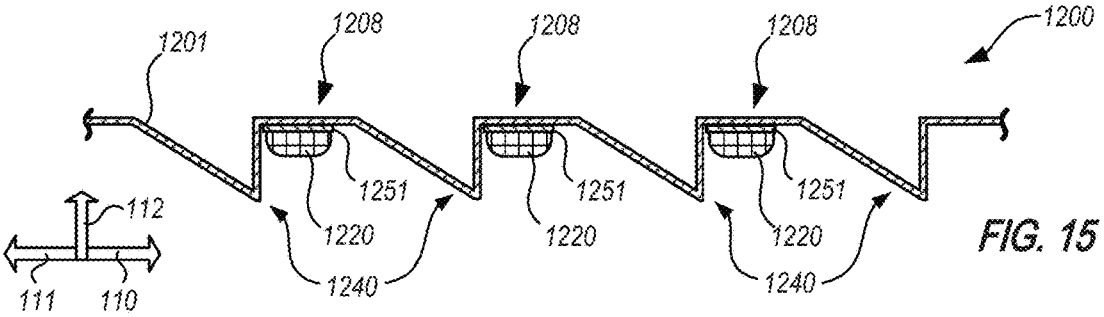
FIG. 15 illustrates another luminaire portion, in accord with an embodiment.

FIG. 15 illustrates a luminaire portion 1200 that is similar to portions 800, 900, 1000 and 1100 shown in FIGS. 11 through 14. In luminaire portion 1200, structural support 1201 forms reflector sections 1240 and PCB mounting regions 1205. Structural support 1201 may be made, for example, by pressing or bending a metal sheet, or by molding or vacuum forming plastic. PCBs 1251 couple with mounting regions 1205 and provide connectivity for light engines of portion 1200 (which light engines are hidden within dome optics 1220), and dome optics 1220 may form flat surfaces that abut and/or seal against PCBs 1251. Reflectors 1240 may include angled and/or curved surfaces, such as shown in FIGS. 8 and 9. Dome optics 1220 may be manufactured and installed individually, or in integrated strips, as discussed above in connection with FIGS. 10A and 10B.

Figure 16:
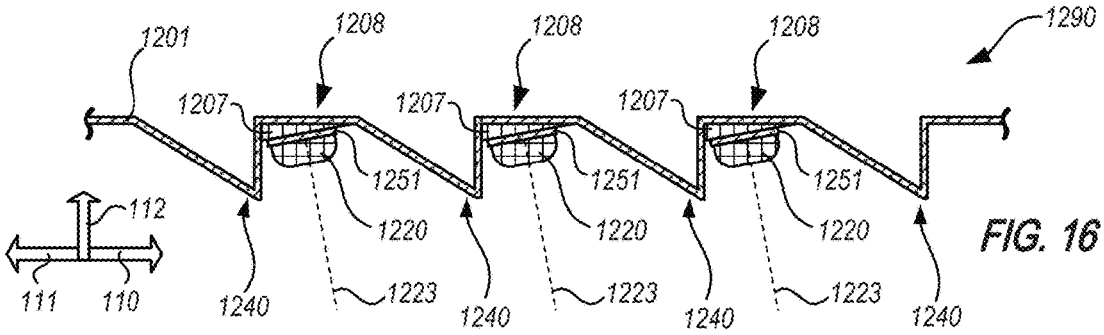
FIG. 16 illustrates another luminaire portion, in accord with an embodiment.
Figure 17:
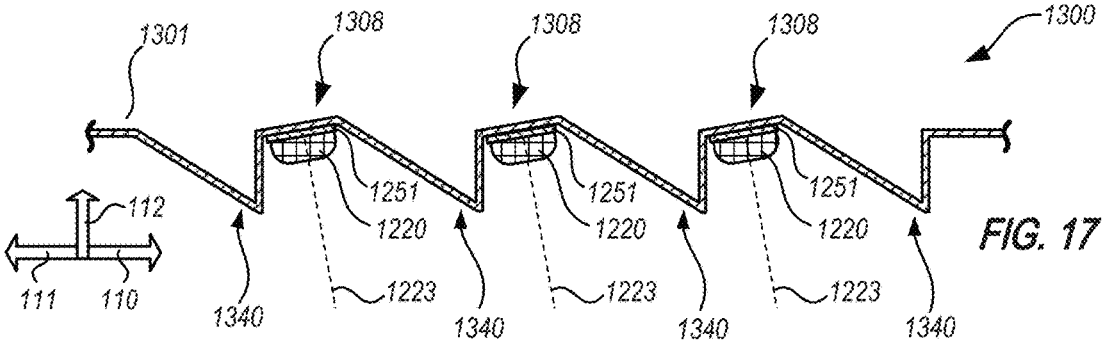
FIG. 17 illustrates another luminaire portion, in accord with an embodiment.

FIG. 16 illustrates a luminaire portion 1290 that is similar to portion 1200 shown in FIG. 15, except that PCBs 1251 couple with wedges 1207 instead of directly with structural support 1201. Wedges 1207 may be manufactured and installed individually, or in integrated strips, similar to PCBs and/or dome optics, as discussed above. Wedges 1207 may be made by milling or cutting bulk material into the desired shape, or by molding or casting any suitable material. Wedges 1207 tilt light engines toward forward horizontal direction 110, to take advantage of a native photometric distribution of the light engines. That is, for example, if the light engines are Lambertian emitters, they will emit most strongly along their optical axes 1223, and wedges 1207 will tilt optical axes 1223 toward the forward horizontal direction 110, as shown. FIG. 17 illustrates a luminaire portion 1295 that is similar to portion 1290 shown in FIG. 16, except that the slope provided by wedges 1207 in portion 1290 is instead provided by slanting portions 1208 of a structural support 1301, which also forms reflector portions 1340.

Figure 18:
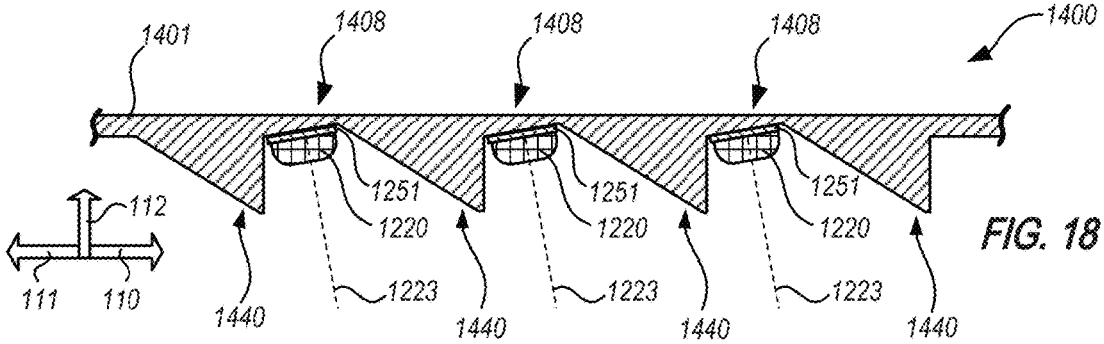
FIG. 18 illustrates another luminaire portion, in accord with an embodiment.

FIG. 18 illustrates a luminaire portion 1400 that is also similar to portions 1290 and/or 1300, with the difference that structural support 1401 is formed of solid piece of material, which may provide extra ruggedness as compared to portions 1290 and/or 1300. Although portion 1400 is shown with sloped portions 1408 where PCBs 1251 and dome optics 1220 are mounted, an equivalent portion could also be made without the slope of portions 1408, that is, with horizontal mounting regions as shown in portions 800, 900, 1000, 1100 and 1200 of FIGS. 11 through 15.

Figure 19:
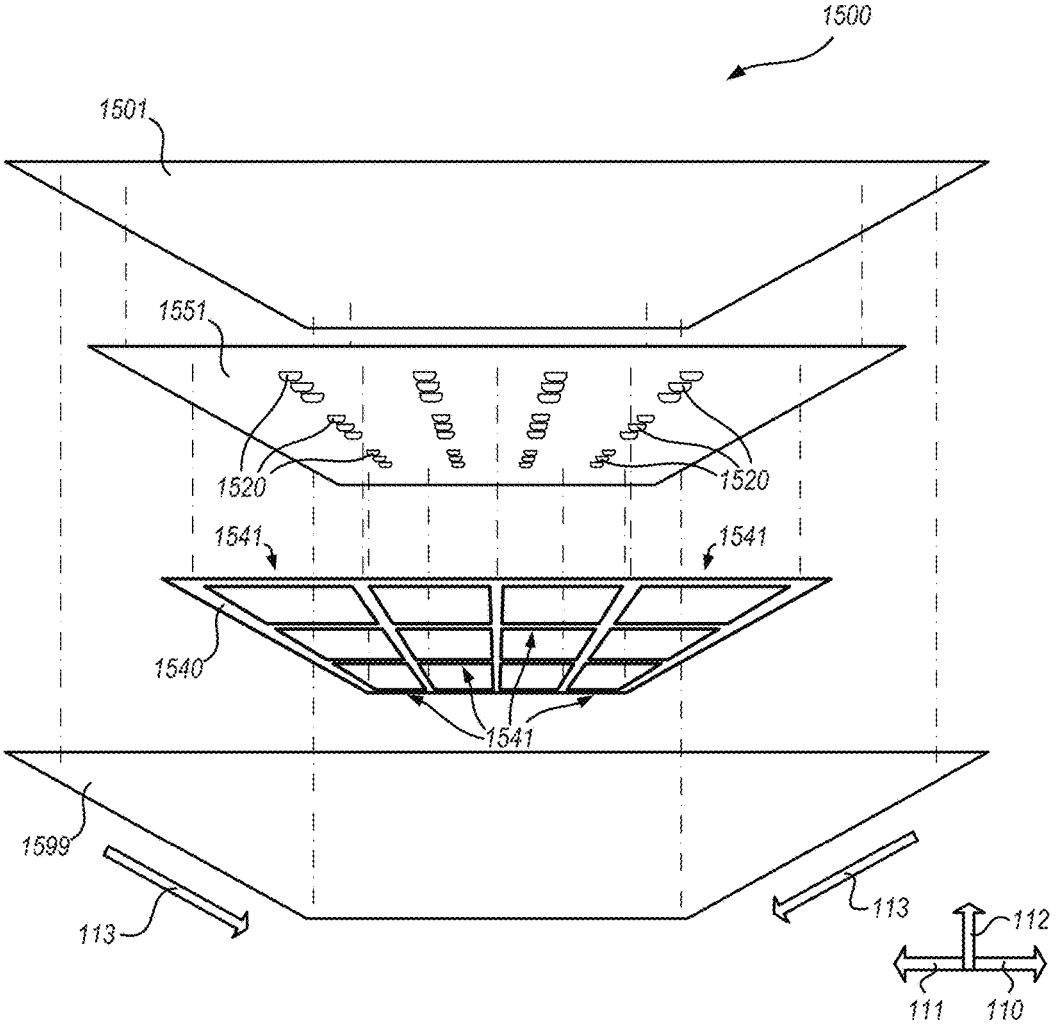
FIG. 19 is a schematic exploded diagram of components of a luminaire 1500 that utilizes asymmetric optics, in accord with an embodiment.

FIG. 19 is a schematic exploded diagram of components of a luminaire 1500 that utilizes asymmetric optics. Luminaire 1500 and its components are depicted schematically only as an aid to understanding; actual embodiments of luminaire 1500 may and likely will be different in appearance, shape and the like. Luminaire 1500 includes an outer housing 1501 and a light assembly portion 1551 that includes light engines within dome optics 1520. Optionally, luminaire 1500 may also include a reflector array 1540 and a translucent or transparent cover 1599. Luminaire 1500 may be marketed, sold and/or installed with or without reflector array 1540, which can adjust the photometric distribution of light from luminaire 1500. Similarly, luminaire may be marketed, sold and/or installed with or without transparent cover 1599, which may also alter the photometric distribution of light from luminaire 1500, and which may help protect light assembly portion 1551 and/or other components of luminaire 1500 in outdoor environments. Reflector array 1540 features reflectors that extend along transverse horizontal direction 113, and which may connect at regions 1541, as shown, to form a gridlike structure. Regions 1541 where reflectors attach with one another may be at ends of the reflectors, in middle locations, or both as shown in FIG. 19. Reflector array 1540 may be attached, detached and/or exchanged for another reflector array 1540 having different characteristics, to customize luminaire 1500. When cover 1599 is included in luminaire 1500, cover 1599 may also attach removably so that it can be removed for access to reflector array 1540, and later reattached. Luminaire 1500 will typically also include a support system (e.g., a pole, or hardware for mounting luminaire 1500 to an object), connections to external power, and power supplies to provide power to the light engines. One of ordinary skill in the art will readily recognize many alternatives, modifications and equivalents for mounting luminaire 1500. Also, it should be clear that references herein to "horizontal" and "vertical" are only with respect to the reference frames of the described embodiments; that is, optical assemblies and luminaires described herein may be mounted at any angle in order to provide a desired light distribution for a given application.

Figure 20:
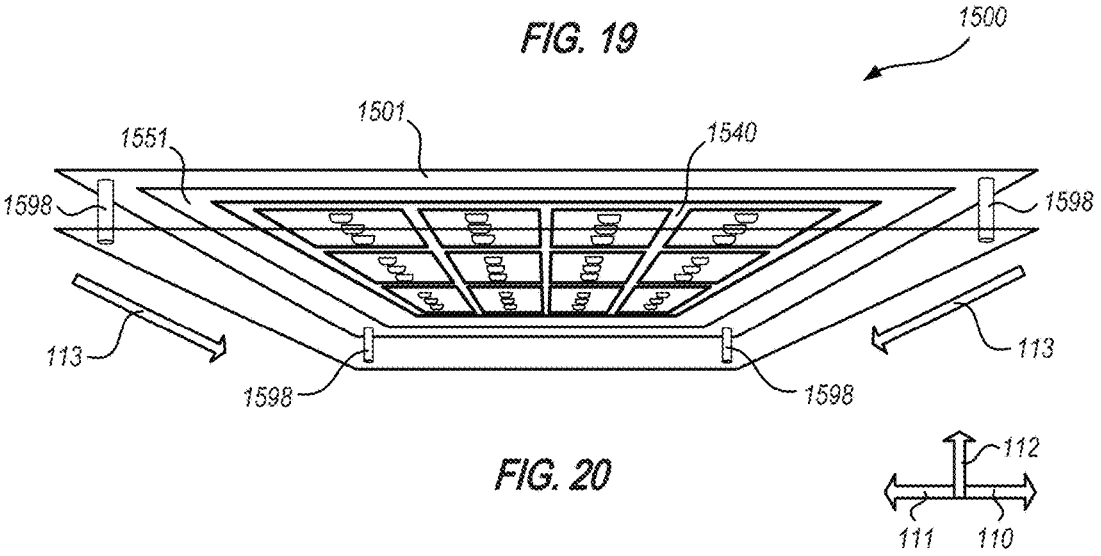
FIG. 20 schematically illustrates the luminaire of FIG. 19 in an assembled state, in accord with an embodiment.

FIG. 20 schematically illustrates luminaire 1500 in an assembled state. Reflector array 1540 and light assembly portion 1551 attach to housing 1501. Optional cover 1599 attaches to housing 1501 using fasteners 1598, which may create a standoff height between housing 1501 and cover 1599 to allow room for reflector array 1540 and light assembly portion 1551.

Figure 21:
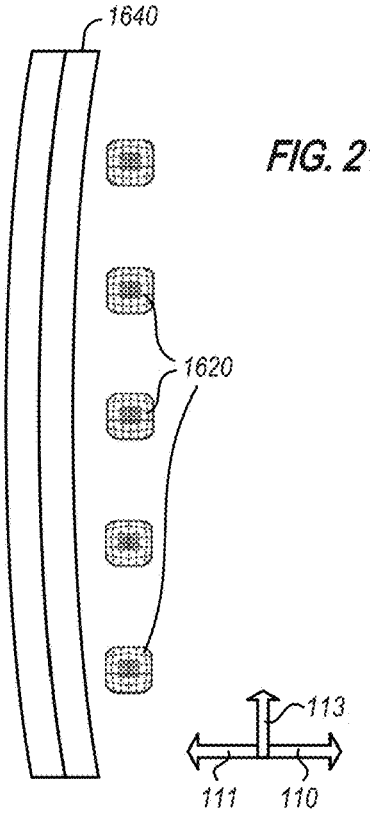
FIG. 21 schematically illustrates a reflector that is azimuthally curved in a concave shape with respect to a group of light engines and their associated dome optics, in accord with an embodiment.

FIGS. 21 through 24 are top plan views that schematically illustrate configurations of azimuthally curved reflectors for customizing photometric distributions of luminaires, in transverse horizontal direction 113. FIG. 21 schematically illustrates a reflector 1640 that is azimuthally curved in a concave shape with respect to a group of light engines and their associated dome optics 1620. The amount of curvature illustrated in FIG. 21 is exemplary only; an actual amount of curvature can be chosen by a designer or selected by an end user by selecting from a set of reflector specifications offering different curvatures. Reflector 1640 may present a vertical reflecting surface toward optics 1620 (and/or a slanted reflecting surface to one or more other optics located behind reflector 1640) similar to any of reflectors 140, 240, 540, 640, 740, 840, 940, 1040, 1140, 1240, 1340, 1440 and/or 1540 discussed above. In addition to the azimuthal curvature illustrated in FIG. 21, vertical and/or slanted reflecting surfaces of reflector 1640 can also be customized. Reflector 1640 will generate a converging reflection of light from optics 1620 such that the light initially concentrates in forward horizontal direction 110, and later diverges. This effect can be used to modify a photometric distribution of a luminaire including reflector 1640, for example to concentrate the photometric distribution at a particular distance from the luminaire.

Figure 22:
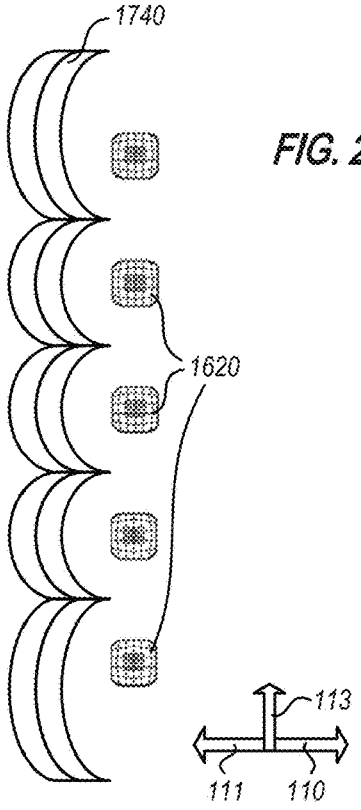
FIG. 22 illustrates a reflector that is azimuthally curved in a concave shape with respect to individual ones of optics, in accord with an embodiment.

FIG. 22 illustrates a reflector 1740 that is azimuthally curved in a concave shape with respect to individual ones of optics 1620. Similar to reflector 1640, azimuthal curvature of reflector 1740 will generate converging reflections of light from individual ones of optics 1620, which can be used for similar purposes as described above. Although the curvatures illustrated are exemplary only, differing curvatures may be formed with respect to different ones of optics 1620, as shown in FIG. 22.

Figure 23:
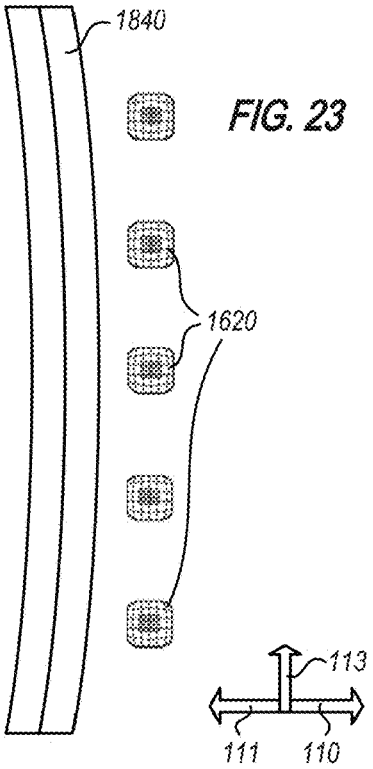
FIG. 23 schematically illustrates a reflector that is azimuthally curved in a convex shape with respect to a group of optics, in accord with an embodiment.
Figure 24:
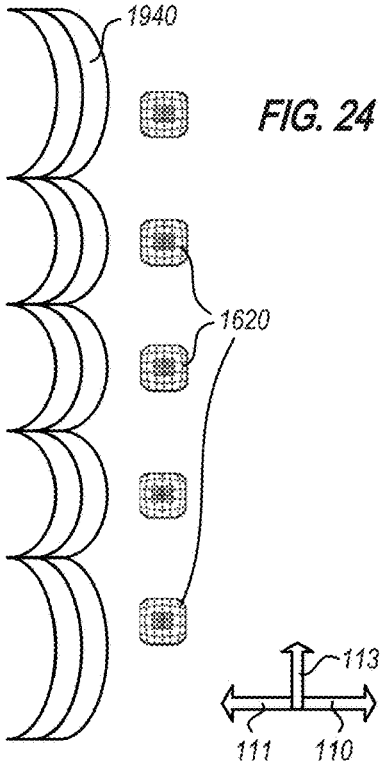
FIG. 24 illustrates a reflector that is azimuthally curved in a convex shape with respect to individual ones of optics, in accord with an embodiment.

FIG. 23 schematically illustrates a reflector 1840 that is azimuthally curved in a convex shape with respect to a group of optics 1620. Reflector 1840 will generate a diverging reflection of light from optics 1620. This effect can be used to modify a photometric distribution of a luminaire including reflector 1840, for example to provide a spatially wide photometric distribution. FIG. 24 illustrates a reflector 1940 that is azimuthally curved in a convex shape with respect to individual ones of optics 1620. Similar to reflector 1840, azimuthal curvature of reflector 1740 will generate diverging reflections of light from individual ones of optics 1620, which can be used for similar purposes as described above. Although the curvatures illustrated are exemplary only, differing curvatures may be formed with respect to different ones of optics 1620, as shown in FIG. 24.

Any of the configurations schematically illustrated in FIGS. 21 through 24 may be combined into arrays of reflectors, as illustrated in FIGS. 19 and 20. Embodiments may also include reflectors that have mixtures of convex, concave and/or straight sections. Any combination of reflectors having azimuthal curvatures that are uniformly concave, convex or straight, or have azimuthal curvatures mixing concave, convex and/or straight sections, may be included in the arrays of reflectors illustrated in FIGS. 19 and 20.

Methods of asymmetrically redirecting light, and for configuring or reconfiguring luminaires are possible using the apparatus and modalities disclosed herein. For example, light can be asymmetrically redirected by emitting the light from one or more light engines, refracting the light by a dome optic to form refracted light, and reflecting the refracted light from reflecting surfaces. Refracting light with the dome optic can include concentrating the light along light concentration angles such that the light thus concentrated either emits directly along such angles, or is reflected from a backward to a forward direction, or from a forward to a downward direction, to tailor a resulting light distribution. Refracting light with the dome optic can also include providing a recess in an outer surface of the dome optic that causes light emitted along an optical axis of the dome optic to refract away from the optical axis, to avoid emitting a bright spot directly downward form the dome optic. The light engines and dome optics can be mounted such that light emitting therefrom is generally centered downwardly (e.g., towards nadir), or they can be mounted with a tilt toward the forward direction such that more of the light is emitted in a forward direction than in a backward direction. A first reflecting surface can be a vertical surface behind the dome optic, such that light that is initially emitted toward the first reflecting surface reflects toward the forward direction. A second reflecting surface can be a slanted surface in front of the dome optic such that light that is initially emitted forwardly, reflects downwardly. The combination of light engine, dome optic and reflecting surfaces can be repeated to form rows or arrays of light engines and corresponding reflectors. For example, extending in a transverse direction that is orthogonal to the forward/backward direction, light engines and dome optics can be placed in rows, and the first and second reflecting surfaces can extend in the transverse direction such that single, extended ones of the reflectors can redirect light from the entire row of light engines and dome optics. In the forward and backward direction, multiple ones (or multiple rows) of the light engines and dome optics can be placed, with adjacent ones of the first and second reflectors joined together for low cost. Also, PCBs that provide electrical connections to the light engines, and/or the dome optics, can be manufactured and installed in strips along the transverse direction, for low cost. When adjacent ones of the first and second reflectors are joined in this manner, multiple ones of the joined reflectors can be joined to one another to form arrays of reflectors. Arrays of reflectors can be provided as separate items for luminaires that are equipped with light engines and dome optics in corresponding rows, so that a luminaire can be deployed either as-received (e.g., with no reflectors at all) or with reflector arrays customized to reflect light in particular asymmetric distributions. Covers can be installed to protect the light engines, optics and optional reflector arrays, or can be removed so that the reflector arrays can be removed and/or installed. Luminaires can be mounted horizontally or at any other angle.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, well-known elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. Optics for asymmetrically redirecting a portion of light from one or more light engines toward a forward horizontal direction, a direction opposite the forward horizontal direction being defined as a backward horizontal direction, the optics comprising:

a dome optic that refracts light emitted by one of the one or more light engines to form refracted light;

a first reflecting surface that reflects at least a first portion of the refracted light that is initially emitted toward the backward horizontal direction, toward the forward horizontal direction, wherein the first reflecting surface:

extends substantially vertically and along a transverse horizontal direction that is orthogonal to the forward horizontal direction, is disposed proximate to the dome optic and toward the backward horizontal direction with respect to the dome optic, and has a height that is greater than or equal to a height of the dome optic; and a second reflecting surface that reflects downwardly at least a second portion of the refracted light that is initially emitted in the forward horizontal direction;

wherein the second reflecting surface:

extends substantially in the transverse horizontal direction, is disposed in the forward horizontal direction with respect to the dome optic, and forms an angle of 45 degrees or more with respect to vertical.

2. The optics for asymmetrically redirecting light of claim 1, wherein the first reflecting surface has a height that is greater than or equal to twice the height of the dome optic.

3. The optics for asymmetrically redirecting light of claim 1, wherein the second reflecting surface forms an angle within a range of 50 to 80 degrees with respect to vertical.

4. The optics for asymmetrically redirecting light of claim 1, wherein the dome optic comprises one of glass, acrylic, polycarbonate or silicone.

5. The optics for asymmetrically redirecting light of claim 1, wherein:

the dome optic and the first reflecting surface define a first cutoff angle in the backward horizontal direction;

the dome optic and the second reflecting surface define a second cutoff angle in the forward horizontal direction;

and the first cutoff angle is closer to vertical than the second cutoff angle.

6. The optics for asymmetrically redirecting light of claim 1, wherein:

the one of the one or more light engines is a first one of the one or more light engines and the dome optic is a first dome optic;

and further comprising:

a second dome optic, disposed in the forward horizontal direction with respect to the second reflecting surface, that refracts light emitted by a second one of the one or more light engines; and a third reflecting surface integrated with the second reflecting surface, wherein the third reflecting surface:

extends substantially in the transverse horizontal direction, is disposed proximate to the second dome optic and toward the backward horizontal direction with respect to the second dome optic, extends approximately vertically from a lower edge of the second reflecting surface, and has a height that is greater than or equal to a height of the second dome optic.

7. The optics for asymmetrically redirecting light of claim 6, further comprising a fourth reflecting surface that:

extends substantially in the transverse horizontal direction, is disposed in the forward horizontal direction with respect to the second dome optic, and forms an angle of 45 degrees or more with respect to vertical.

8. The optics for asymmetrically redirecting light of claim 1, wherein:

an inner surface of the dome optic defines a cavity, the inner surface being symmetrical in each of the forward and transverse horizontal directions;

an outer surface of the dome optic is symmetrical in each of the forward and transverse horizontal directions;

a line passing through a centroid of the inner surface and a centroid of the outer surface defines an optical axis;

a planar surface of the dome optic is perpendicular to the optical axis, adjoins the inner surface around a periphery of the inner surface, and adjoins the outer surface around a periphery of the outer surface; and the outer surface extends further from the cavity, at a light concentration angle within a range of 45 to 75 degrees from the optical axis, than at other angles, such that the refracted light is substantially concentrated around the light concentration angle.

9. The optics for asymmetrically redirecting light of claim 8, wherein:

the outer surface of the dome optic defines a length in the transverse horizontal direction and a width in the forward horizontal direction, the width being greater than or equal to the length.

10. The optics for asymmetrically redirecting light of claim 8, wherein the outer surface of the dome optic forms a recess proximate to the optical axis, such that a portion of the light that is emitted proximate to the optical axis by the one of the one or more light engines is refracted away from the optical axis by the dome optic, to avoid projecting the portion of the light as a bright spot along the optical axis.

11. The optics for asymmetrically redirecting light of claim 8, wherein a cross-section of the cavity, along at least one of the transverse horizontal direction or the forward horizontal direction, is substantially hemispherical.

12. The optics for asymmetrically redirecting light of claim 8, wherein a slope of the inner surface approaches perpendicularity to the optical axis proximate to the planar surface, such that a portion of the light that is emitted at a high vertical angle by the one of the one or more light engines is refracted toward the optical axis, to avoid projecting the portion of the light at the high vertical angle.

13. The optics for asymmetrically redirecting light of claim 1, wherein the first and second reflecting surfaces extend in straight lines along the transverse horizontal direction.

14. The optics for asymmetrically redirecting light of claim 1, wherein the first reflecting surface curves azimuthally so as to form a curve that is concave with respect to the one of the one or more light engines.

15. The optics for asymmetrically redirecting light of claim 1, wherein the first reflecting surface curves azimuthally so as to form a curve that is convex with respect to the one of the one or more light engines.

16. The optics for asymmetrically redirecting light of claim 1, wherein an upper portion of the first reflecting surface is planar and forms an upper portion angle with respect to vertical, and a lower portion of the first reflecting surface deviates from the upper portion angle by extending further forward at a lower edge of the lower portion.

17. A method for asymmetrically redirecting light from one or more light engines toward a forward horizontal direction, a direction opposite the forward horizontal direction being defined as a backward horizontal direction, the method comprising:

emitting the light from one of the one or more light engines;

refracting the light emitted by the one of the one or more light engines with a dome optic to form refracted light;

reflecting at least a first portion of the refracted light that is initially emitted toward the backward horizontal direction, from a first reflecting surface, toward the forward horizontal direction, wherein the first reflecting surface:

extends substantially vertically and along a transverse horizontal direction that is orthogonal to the forward horizontal direction, is disposed proximate to the dome optic and toward the backward horizontal direction with respect to the dome optic, and has a height that is greater than or equal to a height of the dome optic; and reflecting downwardly at least a second portion of the refracted light that is initially emitted in the forward horizontal direction, from a second reflecting surface, wherein the second reflecting surface:

extends substantially in the transverse horizontal direction, is disposed in the forward horizontal direction with respect to the dome optic, and forms an angle of 45 degrees or more with respect to vertical.

18. The method of claim 17, wherein:

emitting the light comprises emitting the light from a first one of the one or more light engines;

refracting the light by the dome optic comprises refracting the light by a first dome optic to form first refracted light;

and further comprising:

emitting light from a second one of the one or more light engines that is disposed in the forward horizontal direction with respect to the second reflecting surface;

refracting the light from the second one of the one or more light engines with a second dome optic to form second refracted light; and reflecting at least a portion of the second refracted light that is emitted in the backward horizontal direction, from a third reflecting surface that is integrated with the second reflecting surface, wherein the third reflecting surface:

extends substantially in the transverse horizontal direction, is disposed proximate to the second dome optic and toward the backward horizontal direction with respect to the second dome optic, extends approximately vertically from a lower edge of the second reflecting surface, and has a height that is greater than or equal to a height of the second dome optic.

19. The method of claim 17, wherein:

emitting the light comprises emitting light that is centered about an optical axis, toward an inner surface of the dome optic;

refracting the light by the dome optic comprises passing the light through an outer surface of the dome optic, wherein:

the outer surface is symmetrical in each of the forward and transverse horizontal directions; and the outer surface extends further from the inner surface along a light concentration angle within a range of 45 to 75 degrees from the optical axis, than at other angles, such that the refracted light is substantially concentrated around the light concentration angle.

20. The method of claim 19, wherein:

refracting the light by the dome optic further comprises passing the light through the inner surface of the dome optic;

wherein a slope of the inner surface approaches perpendicularity to the optical axis proximate to an upper surface of the dome optic, such that a portion of the light that is emitted at a high vertical angle by the one of the one or more light engines is refracted toward the optical axis, to reduce light projected at the high vertical angle.

* * * * *